US006151463A

United States Patent [19]

Hamano

[11] Patent Number: 6,151,463

[45] Date of Patent: Nov. 21, 2000

[54] APPARATUS AND METHOD FOR FORMING A TONER IMAGE

[75] Inventor: Shigemichi Hamano, Shizuoka-ken, Japan

[73] Assignee: Canon Kabushiki Kaisha, Tokyo, Japan

[21] Appl. No.: 09/339,251

[22] Filed: Jun. 24, 1999

[30] Foreign Application Priority Data

Jun. 26, 1998 [JP] Japan ..... 10-181102

[51] Int. Cl.[7] ..... G03G 15/20

[52] U.S. Cl. ..... 399/67; 399/69

[58] Field of Search ..... 399/67, 69, 70, 399/44, 320, 328, 330; 219/216, 469, 470; 432/60; 347/156

[56] References Cited

U.S. PATENT DOCUMENTS 5,315,350 5/1994 Hirobe et al. ..... 399/69

6,008,829 12/1999 Wakaymiya et al. ..... 347/156

*Primary Examiner*—Sophia S. Chen

*Assistant Examiner*—Hoan Tran

*Attorney, Agent, or Firm*—Fitzpatrick, Cella, Harper & Scinto

[57] ABSTRACT

It is an object of this invention to provide a copying machine which can suppress an increase in total power consumption of the overall machine. In executing a plural image formation mode in which a plurality of read images are continuously transferred onto an intermediate transfer medium (405) as an image carrier and transferred onto printing media, when a read original toner image formed on a photosensitive member (402) is transferred first onto the intermediate transfer medium (405), a toner image formed on the intermediate transfer medium (405) is then transferred onto a printing medium, and the images are fixed on the printing media by using a fixing roller (407) incorporating two heaters, energization of the two heaters is alternately inhibited at least in the interval between the instant at which one image is transferred onto the intermediate transfer medium (405) and the instant at which a next image is read and transferred, thereby performing control to inhibit the two heaters from simultaneously generating heat.

27 Claims, 25 Drawing Sheets

FIG. 3

| SIGNAL NAME | ABBREVIATED TERM | DIRECTION OF SIGNAL |
|---|---|---|
| PRINTER POWER READY | /PPRDY | PRINTER CONTROLLER ← DC CONTROLLER |
| CONTROLLER POWER READY | /CPRDY | PRINTER CONTROLLER → DC CONTROLLER |
| READY | /RDY | PRINTER CONTROLLER ← DC CONTROLLER |
| PRINT | /PRNT | PRINTER CONTROLLER → DC CONTROLLER |
| TOP OF PAGE | /TOP | PRINTER CONTROLLER ← DC CONTROLLER |
| LINE SYNCHRONIZATION | /LSYNC | PRINTER CONTROLLER ← DC CONTROLLER |
| VIDEO CLOCK | /VCLK | PRINTER CONTROLLER → DC CONTROLLER |
| IMAGE ENABLE | /VDOEN | PRINTER CONTROLLER → DC CONTROLLER |
| IMAGE | /VDO | PRINTER CONTROLLER → DC CONTROLLER |
| CONTROLLER CLOCK | /CCLK | PRINTER CONTROLLER → DC CONTROLLER |
| COMMAND BUSY | /CBSY | PRINTER CONTROLLER → DC CONTROLLER |
| COMMAND | /CMD | PRINTER CONTROLLER → DC CONTROLLER |
| STATUS BUSY | /SBSY | PRINTER CONTROLLER ← DC CONTROLLER |
| STATUS | /STS | PRINTER CONTROLLER ← DC CONTROLLER |
| PAPER FEED | /PFED | PRINTER CONTROLLER ← DC CONTROLLER |
| SPEED CHANGE | /SPCHG | PRINTER CONTROLLER ← DC CONTROLLER |
| PAPER DELIVERY | /PDLV | PRINTER CONTROLLER ← DC CONTROLLER |
| LEADING EDGE OF PAPER | /TOPR | PRINTER CONTROLLER ← DC CONTROLLER |
| STATE CHANGE NOTIFICATION | /CCRT | PRINTER CONTROLLER ← DC CONTROLLER |

APPARATUS AND METHOD FOR FORMING A TONER IMAGE

BACKGROUND OF THE INVENTION

1. Field of the Invention

The present invention relates to an image processing apparatus and method which can print out image information.

2. Description of the Related Art

A conventional apparatus implements a print function with an arrangement like the one shown in FIG. 23. This apparatus is comprised of a host computer 2104, a printer engine 2102, and a printer controller 2103 for transmitting image data from the host computer 2104 in accordance with the operation of the printer engine 2102.

Alternatively, the apparatus is comprised of a host computer 2106, a printer engine 2102, and a printer controller 2103 for transmitting image data, transmitted from the host computer 2106 through a network 2105, in accordance with the operation of the printer engine 2102.

FIG. 24 shows an example of the arrangement obtained by adding an original reader 2501 to the arrangement in FIG. 23. In this arrangement, the original reader 2501 is connected to the host computer 2104 directly or through the network 2105 to impart an original read function.

By changing the arrangement in FIG. 24 to the arrangement in FIG. 25, the print and copy functions are implemented. This arrangement is comprised of a reader unit 2501 for reading originals, a controller unit 2602 for allowing communication between the printer controller 2103 in FIG. 23 and the reader unit 2501, a selector unit 2603 for selecting either the reader unit 2501 or a controller unit 2602, and a communication line 2601 between the reader unit 2501 and the controller unit 2602.

Reference numeral 2101 denotes a video I/F for performing communication between the printer engine 2102 and the printer controller 2103.

Assume that the copy function is implemented by the arrangement shown in FIG. 25. In this case, when images corresponding to a plurality of pages are to be formed, the reader controller exchanges originals on the original reader during the intervals between the images, and returns the scanner to the home position to prepare for the next read scan. For this reason, as the intervals between the images decrease, the load on the scanner motor for driving the scanner head increases, resulting in an increase in power consumption peak during the intervals between the images.

SUMMARY OF THE INVENTION

The present invention has been made to solve the above problem, and has the following arrangement as a means for solving the problem.

According to the present invention, there is provided an image forming method of forming a toner image on a photosensitive member, transferring the toner image formed on the photosensitive member onto a printing medium, and fixing the toner image transferred on the printing medium by using at least two heaters, comprising the step of inhibiting driving of at least one of the heaters in an interval between the instant at which an image is formed and the instant at which a next image is continuously formed.

According to the present invention, there is also provided the method further comprising the step of reading a plurality of original images and sequentially forming images on the photosensitive member.

According to the present invention, there is also provided the method, further comprising the step of inhibiting driving of at least one of the heaters in an interval between the instant at which the image reader unit reads one original image and the instant at which the image reader unit reads a next original image.

According to the present invention, there is also provided the method, further comprising the step of returning an image read head for scanning an original image backward in an interval between the instant at which one original image is read and the instant at which a next original image is read.

According to the present invention, there is also provided the image forming method of forming images corresponding to a plurality of pages on an image carrier capable of carrying images corresponding to a plurality of pages, and sequentially fixing toner images corresponding to the plurality of pages, formed on the image carrier, on printing media by using at least two heaters, comprising the step of inhibiting driving of at least one of the plurality of heaters in an interval between the instant at which one of the toner images corresponding to the plurality of pages is formed and the instant at which the next image is formed.

According to the present invention, there is also provided the method, further comprising the step of forming images corresponding to a plurality of pages on the image carrier by transferring toner images formed on a photosensitive member onto the image carrier.

According to the present invention, there is also provided the method, further comprising the step of reading a plurality of original images and sequentially forming images on the image carrier.

According to the present invention, there is also provided the method, further comprising the step of inhibiting driving of at least one of the plurality of heaters in an interval between the instant at which the image reader unit reads one original image and the instant at which the image reader unit reads a next image.

According to the present invention, there is also provided the method, further comprising the step of moving an image read head for scanning original images backward in an interval between the instant at which one original image is read and the instant at which a next original image is read.

According to the present invention, there is also provided an image processing apparatus comprising, means for forming a toner image on a photosensitive member, means for transferring the toner image formed on the photosensitive member onto a printing medium, fixing means for fixing the toner image transferred onto the printing medium by using at least two heaters, and inhibition means for inhibiting driving of at least one of said plurality of heaters in an interval between the instant at which an image is formed and the instant at which a next image is continuously formed.

According to the present invention, there is also provided an image reader unit for reading an original image.

According to the present invention, there is also provided the apparatus, wherein the inhibition means inhibits driving of at least one of the heaters in an interval between the instant at which the image reader unit reads one original image and the instant at which the image reader reads a next original image.

According to the present invention, there is also provided the apparatus according to claim 12, wherein the image reader unit moves an image read head for scanning an original image backward in an interval between the instant at which one original image is read and the instant at which a next original image is read.

According to the present invention, there is also provided an image processing apparatus comprising, means for forming images corresponding to a plurality of pages on an image carrier capable of carrying images corresponding to a plurality of pages, fixing means for fixing toner images corresponding to the plurality of pages and formed on said image carrier by using at least two heaters, and inhibition means for inhibiting driving of at least one of said heaters in an interval between the instant at which one of the toner images corresponding to the plurality of pages is formed and the instant at which a next image is formed.

According to the present invention, there is also provided the apparatus, further comprising transfer means for transferring a toner image formed on the photosensitive member onto the image carrier.

According to the present invention, there is also provided the apparatus, further comprising an image reader unit for reading a plurality of original images.

According to the present invention, there is also provided the apparatus, wherein the inhibition means inhibits driving of at least one of the heaters in an interval between the instant at which the image reader unit reads one original image and the instant at which a next original image is read.

According to the present invention, there is also provided the apparatus, wherein an image read head for scanning an original image is moved backward in an interval between the instant at which one original image is read and the instant at which a next original image is read.

According to the present invention, there is also provided a computer readable printing medium storing a computer program for executing the image forming method.

According to the present invention, there is also provided a computer program sequence for executing the image forming method.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 3 is a view showing a list of video I/F signals in FIG. 2;

DETAILED DESCRIPTION OF THE PREFERRED EMBODIMENTS

Embodiments of the present invention will be described in detail below with reference to the accompanying drawings.

FIRST EMBODIMENT

Overall Arrangement

Figure 1:
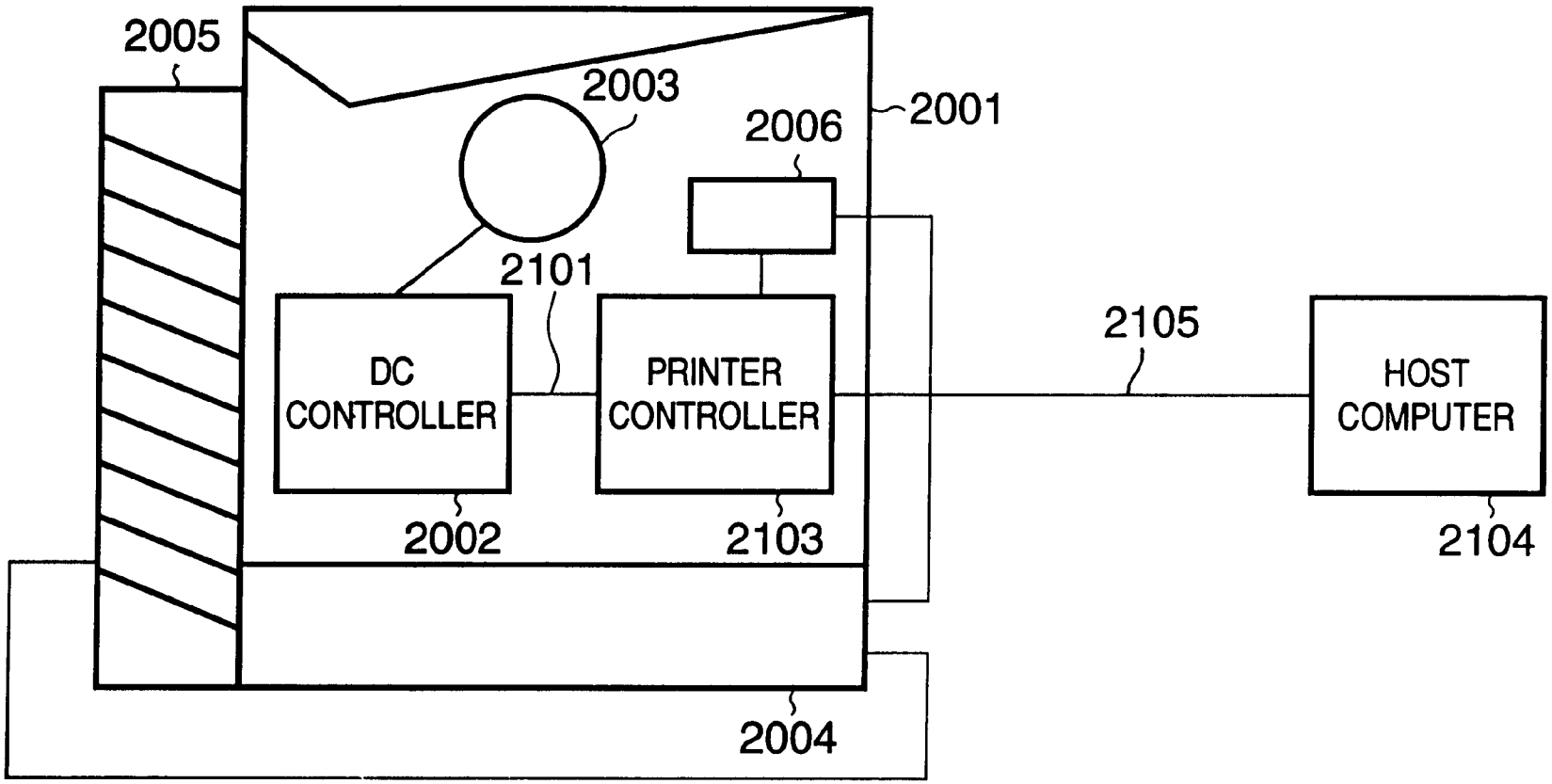
FIG. 1 is a view schematically showing a printer apparatus according to an embodiment of the present invention.

FIG. 1 is a schematic view showing a printer apparatus according to an embodiment of the present invention.

Referring to FIG. 1, reference numeral 2001 denotes a printer main body; 2002, a DC controller for performing paper convey control and image formation control on the printer; 2003, an image forming unit; and 2103, a printer controller incorporated in the printer main body 2001.

In addition, reference numeral 2104 denotes a host computer connected to the printer controller 2103 directly or through a network 2105; 2004, a paper feed cassette deck that can be added as an option to the printer main body 2001; 2005, a sorter that can be added as an option to the printer main body 2001; and 2006, an option controller for controlling the optional cassette deck and the optional sorter.

In this embodiment, the printer unit is a laser beam printer. In this unit, a laser beam is scanned on the surface of the image forming unit 2003 by using, for example, a polygon mirror to form an electrostatic latent image. This image is developed by making a toner adhere to it. The developed image is transferred onto a print sheet and heated/fixed thereon by a fixing unit, thus printing out the image.

Arrangements of Printer Controller and Printer Main Body

The arrangement of a printer engine including the printer controller 2103 and the DC controller 2002 in this embodiment will be described first.

The overall arrangement will be briefly described first with reference to FIG. 1. Reference numeral 2101 denotes a video I/F, which performs communication between the engine unit of the printer main body and the printer controller 2103 through the DC controller 2002. The respective signals in this I/F will be described in detail later.

The DC controller 2002 causes the image forming unit 2003 to form an image on the basis of an electrical image signal received from the printer controller 2103 through the video I/F 2101. This image is formed into a visible image. The image is transferred onto a print sheet and fixed thereon. Thereafter, the print sheet is output. The DC controller 2002 controls various loads to realize this image formation sequence. The DC controller 2002 also has the function of detecting the state of the printer and notifying the printer controller 2103 of the detected state.

Figure 23:
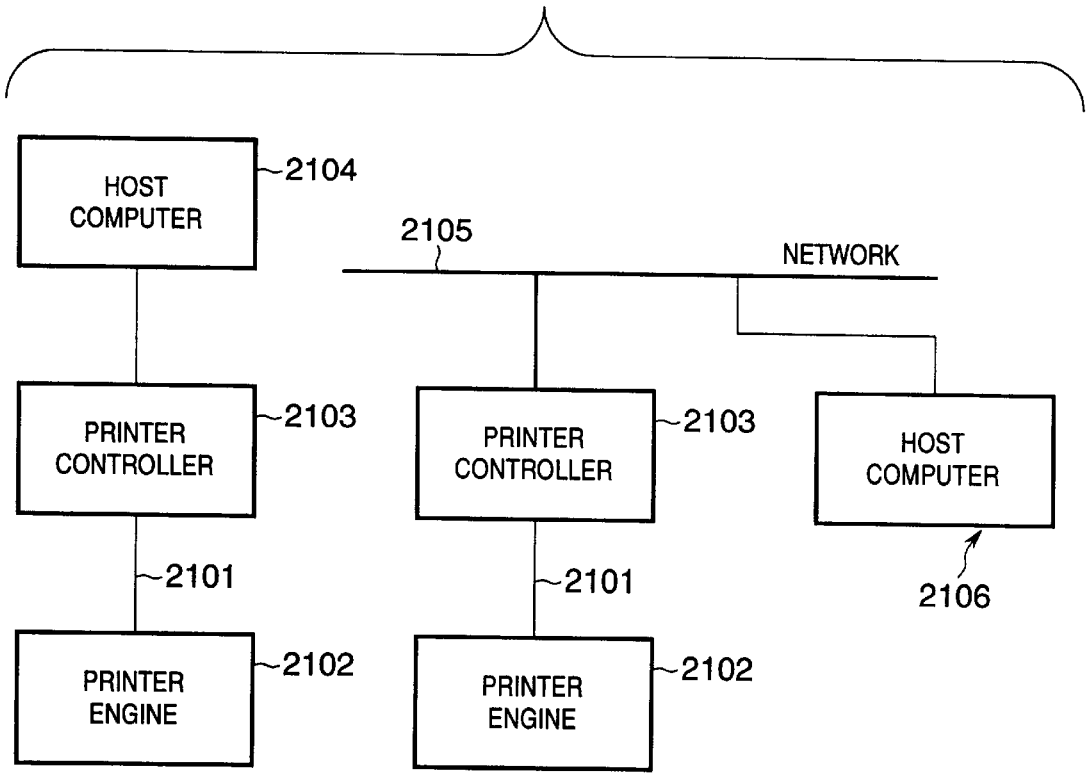
FIG. 23 PRIOR ART
FIG. 23 is a connection diagram of a general printe system.
Figure 24:
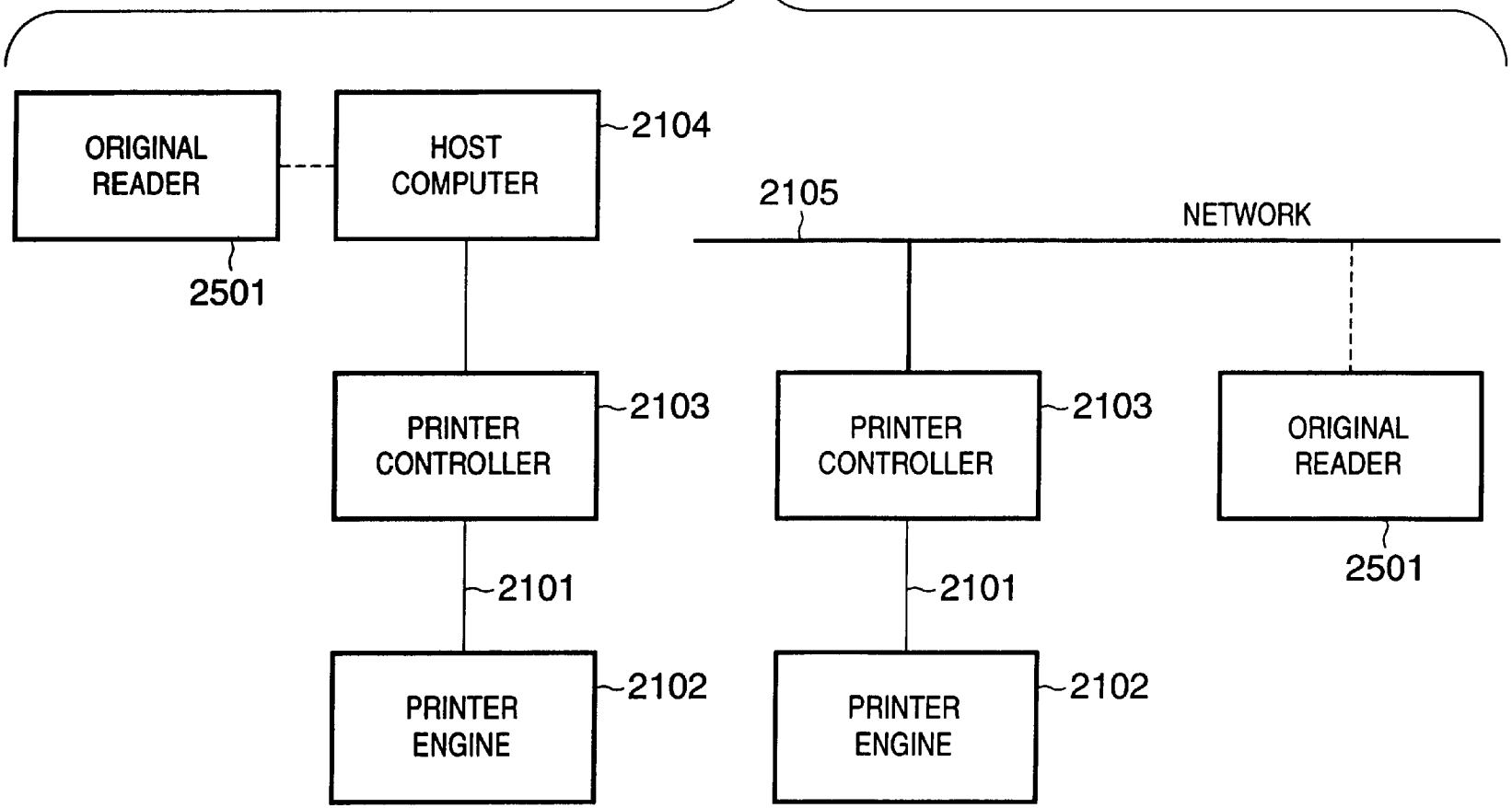
FIG. 24 PRIOR ART
FIG. 24 is a block diagram showing how a reader is attached in the prior art.
Figure 25:
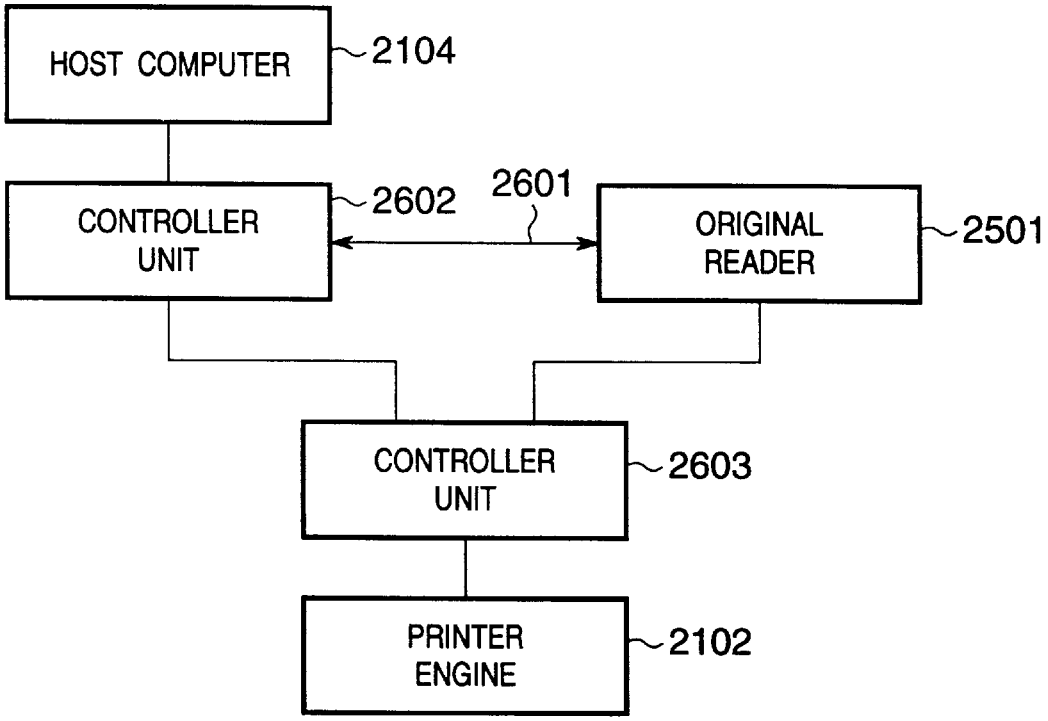
FIG. 25 PRIOR ART
FIG. 25 is a block diagram showing how a reader is attached in the prior art.

The printer controller 2103 may be designed to receive data sent from the host computer 2104 or through the network 2105 in FIG. 23. Such data are sent in various formats. For example, bitmap data and data written in a PDL (Page Description Language) are sent.

This data is bitmapped in the built-in memory and transferred as data in the raster form to the DC controller 2002. In this manner, the data formed by the host computer 2104 can be printed out.

The video I/F 2101 that connects the printer controller 2103 to the DC controller 2002 will be described in detail next with reference to FIGS. 2 and 3.

Figure 2:
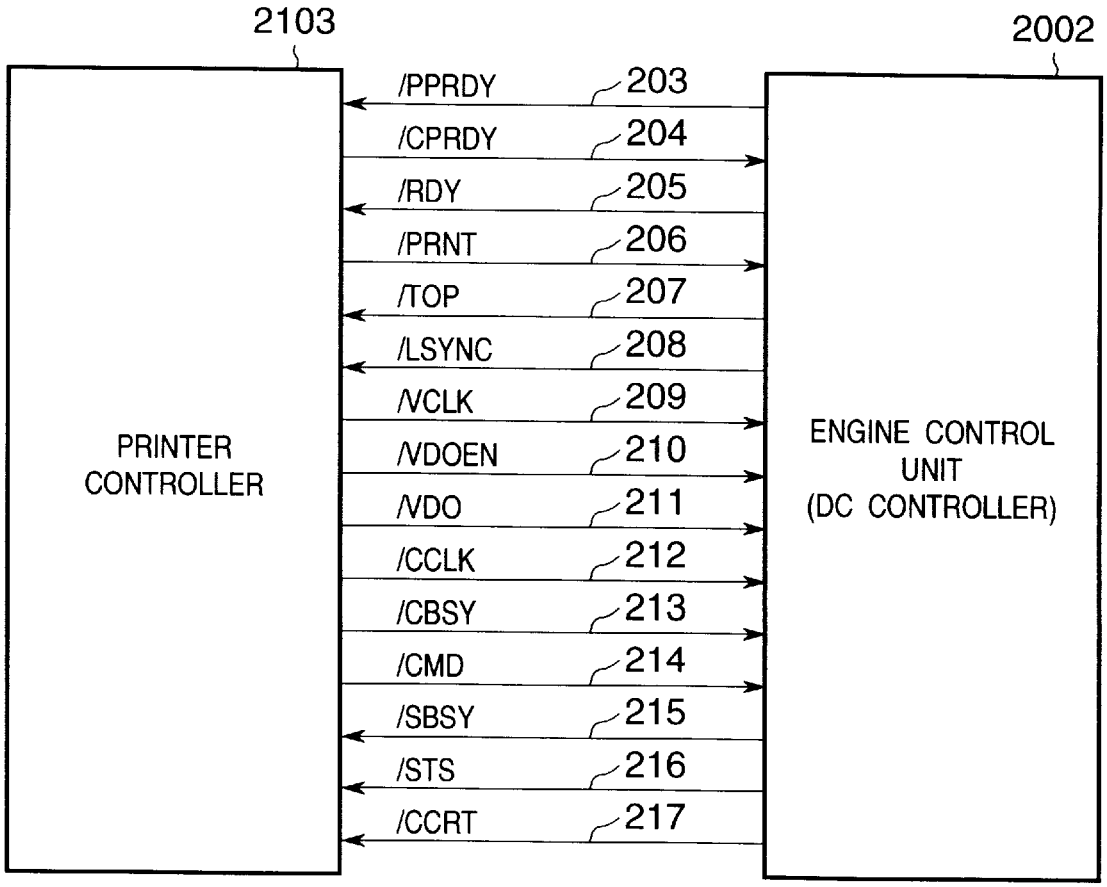
FIG. 2 is a view for explaining a video I/F for connecting a video I/F printer controller and a DC controller in the embodiment in FIG. 1 in detail.

FIG. 2 shows the arrangement of the video I/F 2101. FIG. 3 shows a list of signals in the video I/F 2101. The typical signals shown in FIG. 2 will be described below.

First of all, a signal /PPRDY 203 is a signal for indicating that communication with the printer controller 2103 can be performed after power is supplied to the printer and processing such as initialization is complete. A signal /CPRDY 204 indicates that communication with the engine control unit (DC controller) 2002 can be performed after power is supplied to the printer controller 2103 and processing such as initialization is complete.

A signal /RDY 205 indicates that the engine control unit (DC controller) 2002 can perform print operation in accordance with a print start command (signal /PRNT to be described later) from the printer controller 2103. This signal becomes true only when the respective components of the printer operate normally, e.g., the temperature of the fixing unit (not shown) has reached a predetermined temperature, no print sheet is left in the printer, and the polygon mirror is rotating at a predetermined speed.

A signal /PRNT 206 is a signal used by the printer controller 2103 to command the engine control unit (DC controller) 2002 to start or continue print operation. A signal /TOP 207 is a sync signal transferred from the engine control unit (DC controller) 2002 to the printer controller 2103 and serving as a reference to vertical scanning of an image. This signal is output a predetermined period of time after the signal /PRNT 206 is output from the printer controller 2103.

A signal /LSYNC 208 is a sync signal used by the printer controller 2103 for horizontal scanning. Similar to the signal /TOP 207, the signal /LSYNC 208 is output a predetermined period of time after the signal /PRNT 206 is output from the printer controller 2103. A signal /VCLK 209 is a sync clock for signals /VDOEN and /VDO to be described later. The printer controller 2103 generates a clock having a frequency corresponding to an image signal.

A signal /VDOEN 210 is a signal for controlling reception of an image signal output from the printer controller 2103 into the engine control unit (DC controller) 2002. In synchronism with the signal /VCLK 209, the engine control unit (DC controller) 2002 detects whether the signal /VDOEN 210 is TRUE (ON)/FALSE (OFF). If this signal is TRUE (ON), the engine control unit (DC controller) 2002 receives the image signal. If the signal is FALSE (OFF), the engine control unit (DC controller) 2002 does not receive the image signal.

A signal /VDO 211 is image data. The printer controller 2103 outputs the signal /VDO 211 in synchronism with the signal /VCLK 209 with reference to the signal /TOP 207 in the vertical direction and the line sync signal /LSYNC in the horizontal direction.

A signal /CCLK 212 is a sync clock used when the printer controller 2103 transmits a serial command to the engine control unit (DC controller) 2002, and when the engine control unit (DC controller) 2002 returns serial status data to the printer controller 2103. This signal is output from the printer controller 2103.

A signal /CBSY 213 indicates to the engine control unit (DC controller) 2002 that the printer controller 2103 is transmitting a serial command by using a signal /CMD 214 (to be described below).

The signal /CMD 214 is used when the printer controller 2103 is to transmit serial information to the engine control unit (DC controller) 2002. In the following description, this serial information will be referred to as a command.

A signal /SBSY 215 indicates to the printer controller 2103 that the engine control unit (DC controller) 2002 is returning serial status data by using a signal /STS 216.

The signal /STS 216 is used when the engine control unit (DC controller) 2002 returns serial information to the printer controller 2103. Serial information will be referred to as status data.

A signal /CCRT 217 is a signal for notifying the printer controller 2103 of a change in status in the printer. Upon reception of this notification, the printer controller 2103 issues a command to inquire what has changed in state on the engine side by using the signal /CMD 214. In response to this command, the engine control unit (DC controller) 2002 notifies the printer controller 2103 of the state by using the signal /STS 216.

Figure 4:
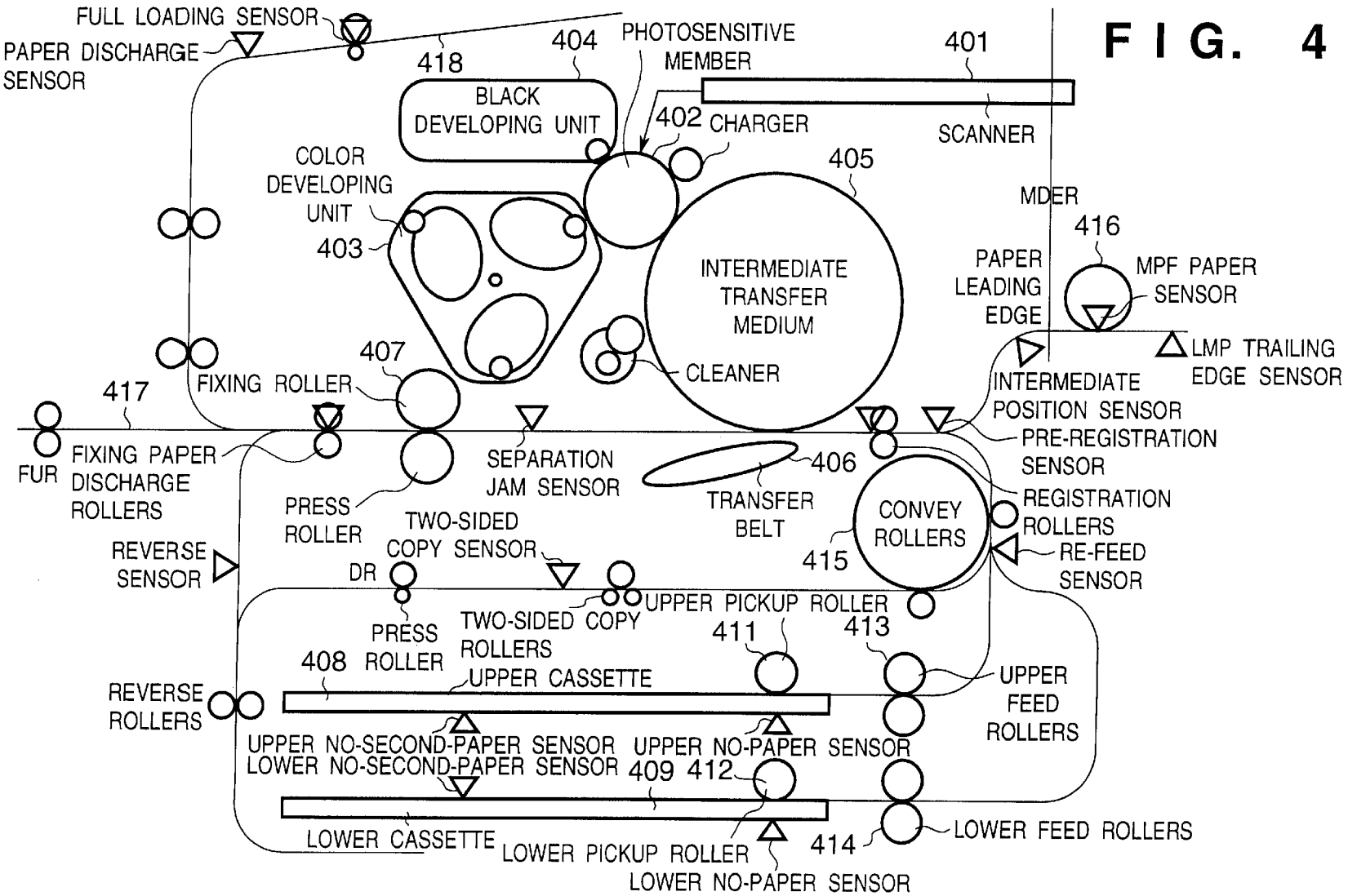
FIG. 4 is a view showing print sheet convey control when the printer of this embodiment is viewed from the front side.

The printer controlled by the engine control unit (DC controller) 2002 will be described with reference to FIG. 4. FIG. 4 shows print sheet convey control when the printer is viewed from the front side.

Referring to FIG. 4, reference numeral 401 denotes a scanner for scanning the surface of a photosensitive member 402 with a laser beam emitted by a semiconductor laser and modulated with an image signal using the polygon mirror. The scanner 401 receives the image signal /VDO 211 sent from the printer controller 2103, converts the signal into a laser beam, and irradiates the photosensitive member 402 with the laser beam, thereby forming an electrostatic latent image on the photosensitive member 402.

The photosensitive member 402 reaches a color developing unit 403 and a black developing unit 404 while rotating counterclockwise. The developing units 403 and 404 serve to apply a toner (develop the image) on the photosensitive member 402 in accordance with the charge stored on the photosensitive member 402. When a monochrome image is to be formed, only the developing unit 404 operates. When a color image is to be formed, both the developing units 403 and 404 are used.

The image formed on the photosensitive member 402 is transferred onto an intermediate transfer medium 405 serving as an image carrier and rotating clockwise. When a monochrome image is to be formed, the intermediate transfer medium 405 makes one revolution. When a color image is to be formed, the intermediate transfer medium 405 makes one revolution for each color (when, for example, toners of four colors, i.e., yellow, magenta, cyan, and black, are to be used, the intermediate transfer medium 405 makes four revolutions). In this manner, image formation on the intermediate transfer medium 405 is completed.

Note that the area of the outer surface of the intermediate transfer medium 405 corresponds to A3-size paper. In A4-size print operation, the intermediate transfer medium 405 can simultaneously carry two A4-size images.

A print sheet fed from an upper or lower cassette 408 or 409 by a pickup roller 411 or 412 is conveyed by feed rollers 413 or 414. This sheet is further conveyed to a registration position by convey rollers 415.

Timing control is performed to set this print paper between the intermediate transfer medium 405 anda transfer belt 406 at the timing at which image formation on the intermediate transfer medium 405 is completed. When the print sheet reaches this position, the transfer belt 406 comes into contact with the intermediate transfer medium 405 to transfer the toner image, formed on the intermediate transfer medium 405, onto the print sheet. The image transferred onto the print sheet is heated/pressurized by a fixing roller 407 to be fixed on the print sheet. The fixing roller 407 incorporates two heaters.

The image-fixed print sheet is conveyed to one of a face-up paper discharge port 417 and a facedown paper discharge port 418 which is designated by the printer controller 2103 in advance and discharged therefrom.

With the above control, the image information sent from the printer controller 2103 can be output.

Figure 5:
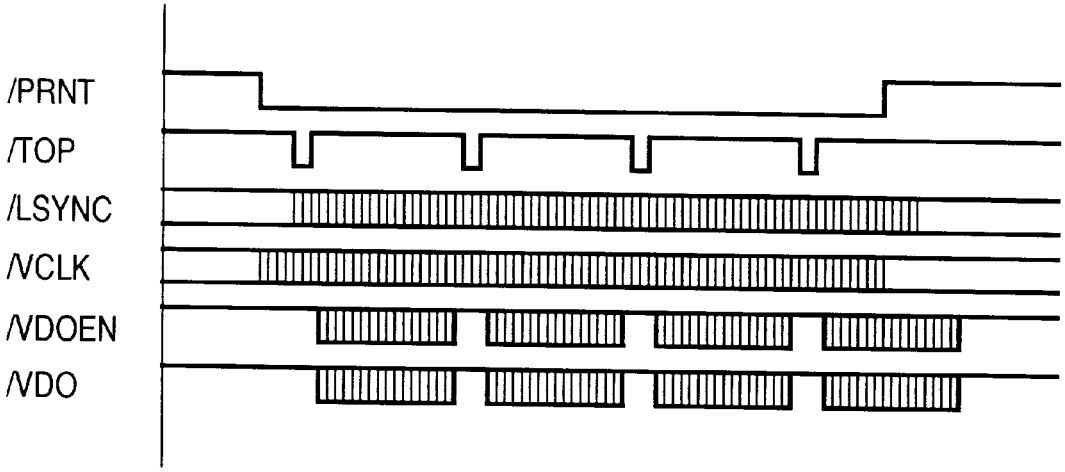
FIG. 5 is a timing chart showing the image signal timing of the video I/F in this embodiment.

FIG. 5 shows the timing of signals exchanged with the video I/F 2101. This chart shows the operation associated with the signals in the video I/F 2101 described above in chronological order.

When image information is completely prepared in the printer controller 2103, the signal /PRNT 206 is set at low level (true) to notify the engine control unit (DC controller) 2002 of the corresponding information. At the same time, the image sync signal /VCLK 209 used for the transfer of the image signal is also generated.

In response to this signal, the engine control unit (DC controller) 2002 performs various settings and the like in the printer. When the printer is ready for receiving the image information, the engine control unit (DC controller) 2002 outputs the signal /TOP 207 and the signal /LSYNC 208 to the printer controller 2103. In synchronism with the vertical sync signal /TOP 207 and the horizontal sync signal /LSYNC 208, the printer controller 2103 transfers the image signal /VDO 211 and the image enable signal /VDOEN 210 to the engine control unit (DC controller) 2002.

Figure 6:
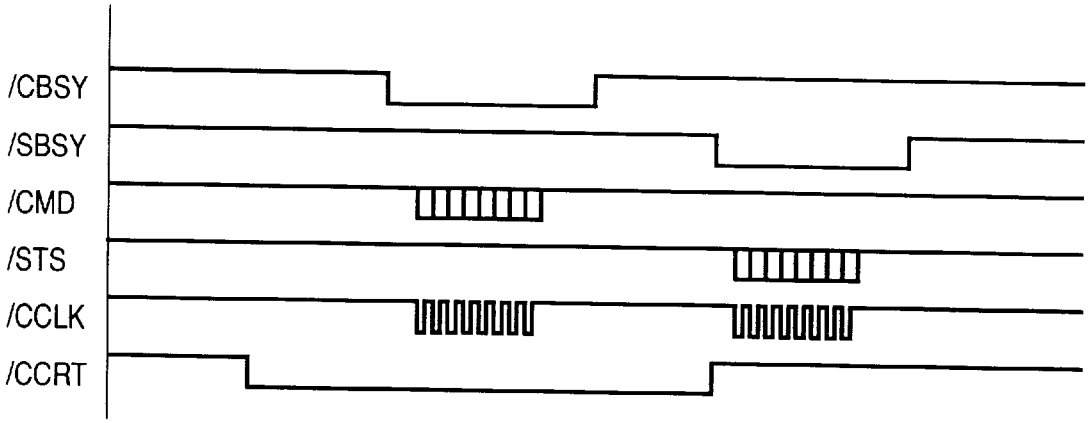
FIG. 6 is a timing chart showing the serial communication timing of the video I/F in this embodiment.

Specific commands and status data which are exchanged in serial communication during print operation will be described next with reference to FIG. 6. FIG. 6 shows the timing of serial communication between the printer controller 2103 and the engine control unit (DC controller) 2002 in this embodiment.

A case in which the signal /CCRT 217 at thelowermost position in FIG. 6 is not used will be described first. When the printer controller 2103 is to issue a command to the engine control unit (DC controller) 2002, the printer controller 2103 sets the signal /CBSY 213 at low level (true) and sends command data over the signal /CMD 214 in synchronism with the signal /CCLK 212.

Upon reception of the command data, the engine control unit (DC controller) 2002 confirms first that the signal /CBSY 213 is at high level (false), and then sets the signal /SBSY 215 at low level (true) to send engine-side status data corresponding to the command over the signal /STS 216 in synchronism with the signal /CCLK 212 generated by the printer controller 2103. The printer controller 2103 receives this status data and continues or interrupts the print control in accordance with the status.

The signal /CCRT 217 will be described next. This signal is set at low level (true) when the engine-side state designated by the printer controller 2103 in advance changes. Assume that the printer controller 2103 is programmed to enable the signal /CCRT 217 with the signal /CMD 214 when a paper-out condition occurs.

Assume that only one print sheet is left, and the printer controller 2103 outputs a request to print out two print sheets. For the first print sheet, print sequence operation is normally performed without any problem. However, since there is no second print sheet, when image formation for the second print sheet is started, a change in state is detected on the printer engine side, and the signal /CCRT 217 is changed from high level to low level. This signal is sent to the printer controller 2103.

Upon detection of this state, the printer controller 2103 issues a command to request a paper feed unit status to the engine control unit (DC controller) 2002 so as to check which paper feed cassette has run of paper. In accordance with this command, the engine control unit (DC controller) 2002 returns status data on the cassette in the paper-out condition to the controller. The signal /CCRT 217 is cleared to high level at the timing at which the status data is returned and the signal /SBSY 215 is set at low level.

Figure 7:
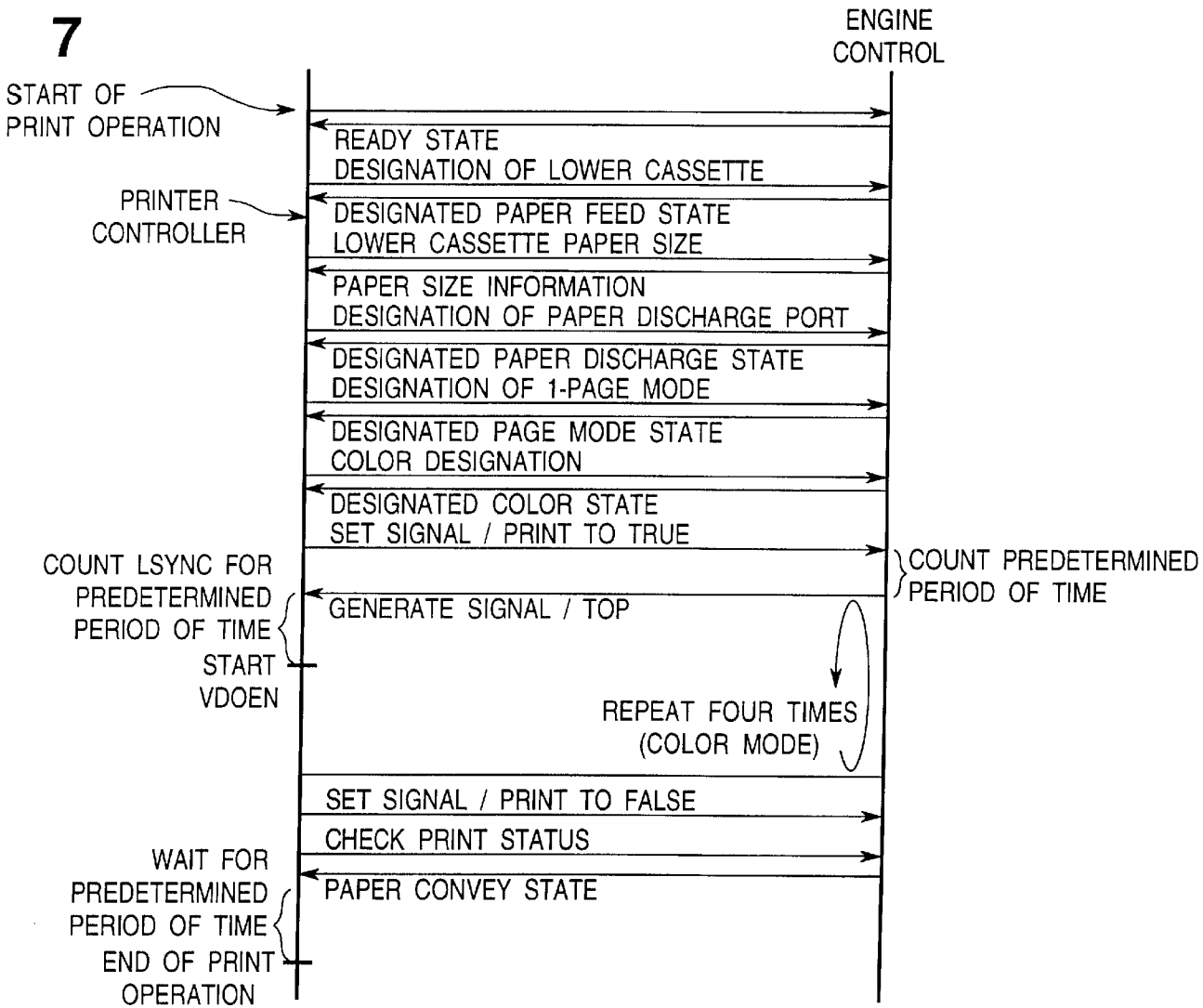
FIG. 7 is a view showing the exchange of commands/status data between the printer controller and the engine control unit (DC controller) in printout operation in this embodiment.

FIG. 7 shows the exchange of commands/status data between the printer controller 2103 and the engine control unit (DC controller) 2002 in more detail. Print operation in this embodiment will be described below with reference to FIG. 7. The following description is based on the assumption that a color printout is to be obtained.

When a print start request is generated, the printer controller 2103 makes the engine control unit (DC controller) 2002 check the ready state of the printer while performing image data conversion and the like. The printer controller 2103 then issues a command to designate a specific cassette from which a print sheet is to be fed. The printer controller 2103 also issues a command to request the print sheet size in the designated cassette. In response to this series of commands, the engine control unit (DC controller) 2002 returns corresponding status data.

The printer controller 2103 then determines a paper discharge port using a command to designate a paper discharge port, and issues a page mode designation command to designate a specific number of pages on which images are to be formed. Finally, the printer controller 2103 issues a command to designate the monochrome/color mode, thus completing all the settings on the printer side.

Subsequently, the printer controller 2103 issues the signal /PRNT 206 as a print request to the engine control unit (DC controller) 2002. In response to this command, the signal /TOP 207 is returned from the engine control unit (DC controller) 2002 after a lapse of a predetermined period of time. The printer controller 2103 transfers the signal /VDO 211 to the engine control unit (DC controller) 2002 in synchronism with the signal /VCLK 209 with synchronization being established with the signal /TOP 207 in the vertical scanning direction and the signal /LSYNC 208 in the horizontal direction.

In this case, since the color mode is set, for example, the signal /TOP 207 is generated four times to form images of four colors, i.e., C, M, Y, and K. After the final signal /TOP 207 is generated, the signal /PRNT 206 is restored to high level (false).

Upon detection of the completion of the print request, the engine control unit (DC controller) 2002 makes a shift to post-processing such as cleaning operation for the intermediate transfer medium. The transferred print sheet passes through the fixing roller 407 and is discharged through the designated paper discharge port.

Finally, the printer controller 2103 makes the engine control unit (DC controller) 2002 confirm that no print sheet is being conveyed (paper discharge operation is complete), and terminates the print operation. The printer controller 2103 then waits in a ready state until the next print request is generated.

If an illegal state, e.g., a paper jam, a paper-out condition, or an open-door state set by the user, occurs during the above operation, the engine control unit (DC controller) 2002 immediately notifies the printer controller 2103 of the abnormal condition of the printer by using the signal /CCRT 217 described above. The printer controller 2103 takes necessary steps in accordance with the abnormal state.

The above processing is performed between the printer controller 2103 and the printer side (DC controller 2002).

Image formation processing is performed in the above manner.

Arrangement with Reader Controller

The above description has exemplified the image formation apparatus to which the printer controller 2103 and the DC controller 2002 are connected. However, the present invention is not limited to the above example. If a reader controller for controlling a reader for reading original images is connected between the printer controller 2103 and the DC controller 2002 to allow the reader to read original images, this apparatus can be used as a copying machine for printing out read original images. An example of such an arrangement will be described below.

Figure 8:
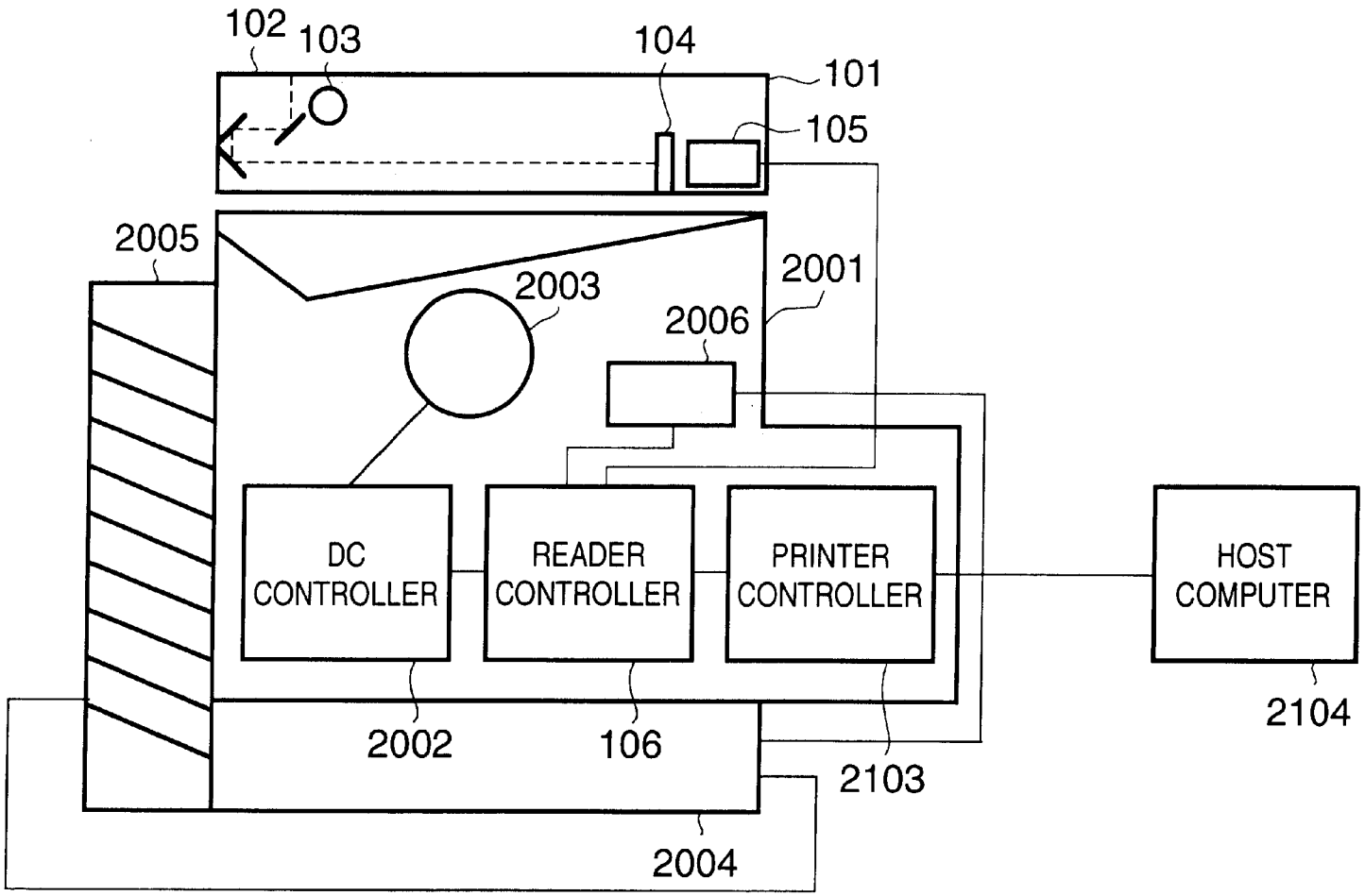
FIG. 8 is a view showing the overall arrangement of the apparatus serving as a copying machine when a reader controller is connected between the printer controller and the DC controller in this embodiment.

FIG. 8 shows the overall arrangement of the apparatus of this embodiment used as a copying machine, in which the reader controller is connected between the printer controller and the DC controller. In the case of the copying machine shown in FIG. 8, a reader controller 106 is connected between the printer controller 2103 and the DC controller 2002 to perform processing between the printer controller 2103 and the DC controller 2002.

Referring to FIG. 8, reference numeral 101 denotes a reader main body; 102, an original table; 103, a light source; 104, a photoelectric conversion means; 105, an analog/digital conversion means; and 106, a reader controller.

Reference numeral 2001 denotes a printer main body; 2002, a DC controller for performing paper convey control and image formation control on the printer engine; 2003, an image forming unit; and 2103, a printer controller incorporated in the main body 2001 as in the first embodiment shown in FIG. 1.

Reference numeral 2104 denotes a host computer identical to the host computer in FIG. 1, which is connected to the printer controller 2103 through the network 2105.

Reference numeral 2004 denotes a paper feed cassette deck that can be added as an option; 2005, a sorter that can be added as an option, and 2006, an option controller for controlling the optional paper feed cassette deck and sorter.

The reader controller 106 has the function of performing communication control between a means for processing digital image data output from the analog/digital conversion means 105, a motor control means (not shown) for original read operation, the DC controller 2002, and the printer controller 2103.

In this embodiment, the reader controller 106 is disposed in the printer main body 2001 so as not use any cable for communication control on the DC controller 2002 and the printer controller 2103 outside the apparatus.

Figure 9:
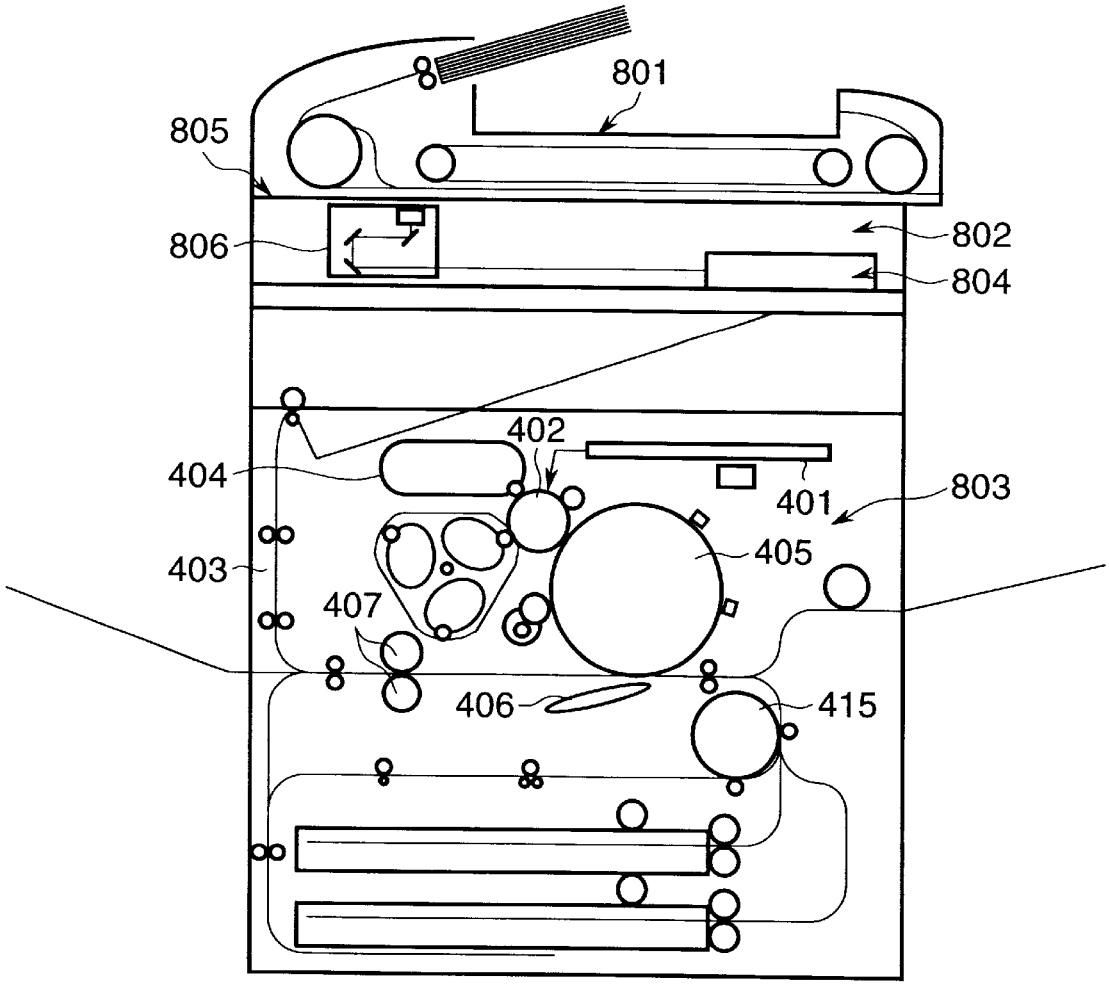
FIG. 9 is a view showing the outer appearance of the apparatus serving as a copying machine in this embodiment.

FIG. 9 is a view showing the outer appearance of this embodiment used as a copying machine. Referring to FIG. 9, reference numeral 801 denotes a document feeder for conveying an original to a portion at which it is optically read; 802, an optical reader; and 805, an original glass table.

The document feeder 801 is driven in synchronism with the optical reader 802. When an original image is fed onto the original glass table 805 by the document feeder 801, the optical reader 802 scans the image while moving an optical read head 806 in the lateral direction in FIG. 9, and sends reflected light having undergone proper optical processing to a photoelectric conversion unit 804. Reference numeral 803 denotes a printer main body.

Figure 10:
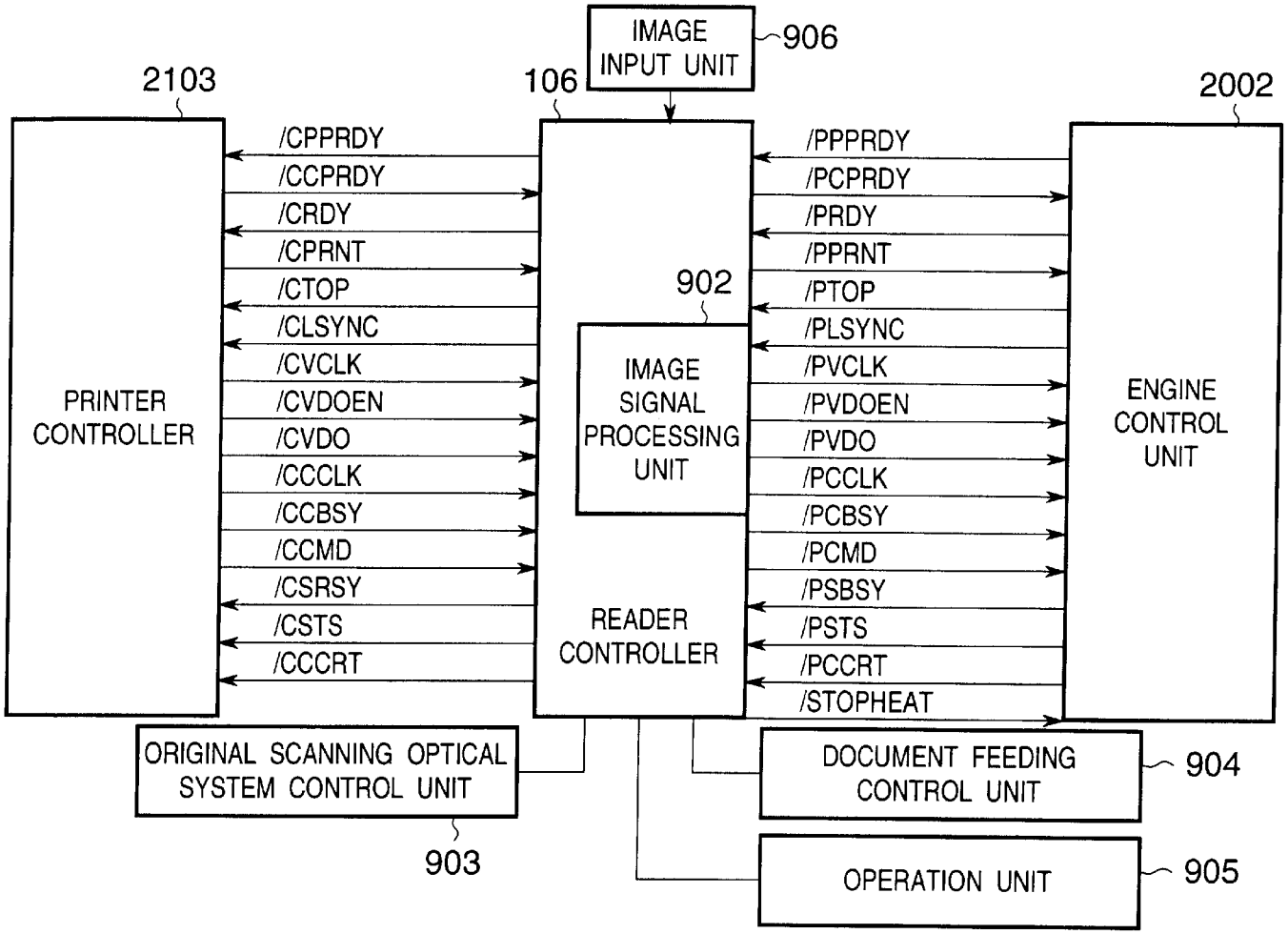
FIG. 10 is a block diagram showing electrical connections between the respective components when the reader controller is attached to the apparatus of this embodiment.

FIG. 10 shows electrical connections in the arrangement obtained when the reader controller 106 for reading original images is attached to the arrangement in FIG. 2 which is constituted by the printer controller 2103 and the engine control unit (DC controller) 2002.

Referring to FIG. 10, reference numeral 106 denotes a reader controller, which is connected between the printer controller 2103 and the engine control unit (DC controller) 2002.

Reference numeral 902 denotes an image signal processing unit; 903, an original scanning optical system control unit; 904, a document feeding control unit 904 for controlling the document feeder 801; 905, an operation unit; and 906, an image input unit. An image signal converted by the photoelectric conversion unit 804 is input through the image input unit 906 and transferred to the image signal processing unit 902 in the reader controller 106.

Referring to FIG. 10, the types of signal lines between the printer controller 2103 and the reader controller 106 and between the engine control unit (DC controller) 2002 and the reader controller 106 are the same as those in FIG. 2.

Since the signals between the reader controller 106 and the printer controller 2103 physically differ from those between the reader controller 106 and the engine control unit (DC controller) 2002, "C" is added to each of the signal names of the former, and "P" is added to each of the signal names of the latter to discriminate them.

Figure 11:
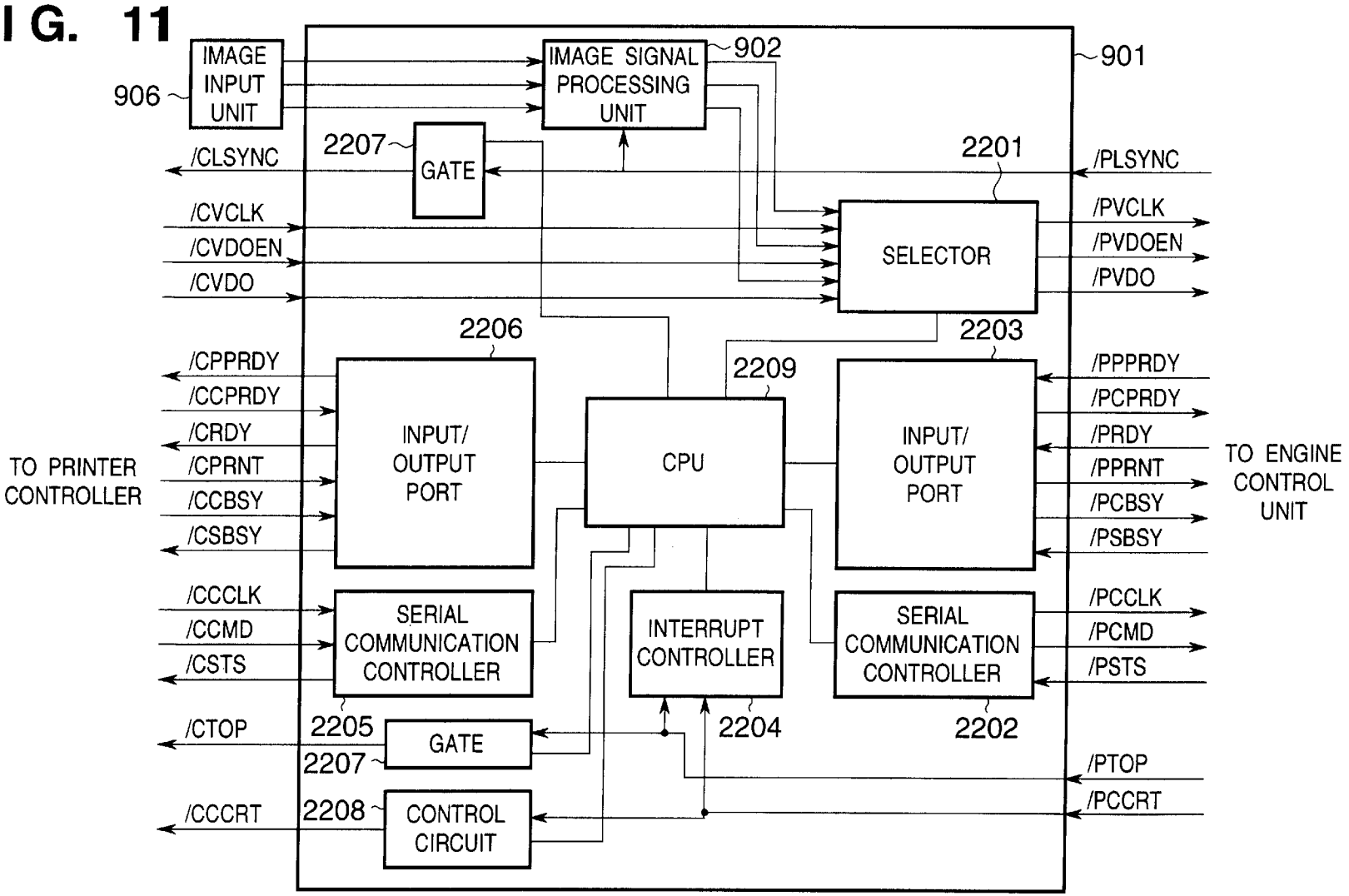
FIG. 11 is a block diagram showing the detailed arrangement of the reader controller in this embodiment.

FIG. 11 shows the detailed arrangement of the reader controller 106. Referring to FIG. 11, reference numeral 106 denotes the reader controller in FIG. 10; 902, the image signal processing unit in FIG. 10; and 906, the image input unit in FIG. 10.

Reference numeral 2201 denotes a selector for selecting either an output from the image signal processing unit 902 or a signal sent from the printer controller 2103 and outputting it to the engine control unit (DC controller) 2002. The signal system switched by the selector 2201 corresponds to the following three signals: an image clock /VCLK, an image enable signal /VDOEN, and image data /VDO.

Reference numeral 2202 denotes a serial communication controller for performing communication with the engine control unit (DC controller) 2002; 2203, an input/output port for exchanging signals for supporting communication with the serial communication controller 2202; and 2204, an interrupt controller. An image leading edge request signal /PTOP and a printer state change signal /PCCRT are input to the interrupt controller 2204.

Reference numeral 2205 denotes a serial communication controller for performing communication with the printer controller 2103; 2206, an input/output port for exchanging signals for supporting communication with the printer controller 2103; and 2207, a gate for performing control to determine whether to send a signal sent from the printer to the printer controller 2103.

The gate 2207 performs control in accordance with a image leading edge request signal /TOP and a line sync signal /LSYNC. Reference numeral 2208 denotes a control circuit having a gate function and a flag setting function and controls a printer state change signal /CCRT. The control circuit 2208 performs control to determine whether to send the printer state change signal /PCCRT issued by the engine control unit (DC controller) 2002 to the printer controller 2103 by enabling/disabling the gate 2207, and can make the reader controller 106 issue the printer state change signal /CCRT to the printer controller 2103 by setting a flag. Reference numeral 2209 denotes a CPU for controlling the overall apparatus.

Copy Operation

A control method to be used when a full-color original image is read and output from the image forming apparatus in this embodiment having the above arrangement will be described below. When the copy start key (not show) on the operation unit 905 is depressed, the reader controller 106 disables the gate 2207 and the control circuit 2208 to execute copy mode operation, and controls the selector 2201 to select an output from the image signal processing unit 902.

Subsequently, the input/output port 2203 is used to make the engine control unit (DC controller) 2002 check a ready state signal /PRDY. The serial communication controller 2202 is used to make various settings.

First of all, the reader controller 106 issues a command to designate a specific cassette from which a print sheet is to be fed. The reader controller 106 also issues a command to request the print sheet size in the designated cassette. In response to this series of commands, the engine control unit (DC controller) 2002 returns corresponding status data.

Subsequently, the reader controller 106 determines a paper discharge port by issuing a command to designate a paper discharge port, and issues a page mode designation command to designate a specific number of pages on which images are formed. Finally, the reader controller 106 issues a command to designate the monochrome/color mode, thus completing all the settings on the printer side.

After an original is fed to the original table by the document feeder 801, the reader controller 106 generates a print request signal /PPRNT to the engine control unit (DC controller) 2002. In response to this signal, the engine control unit (DC controller) 2002 returns a signal /PTOP after a lapse of a predetermined period of time. This signal is processed by the interrupt controller 2204 to operate the optical reader 802 in synchronism with the signal /PTOP.

A signal input from the photoelectric conversion unit 804 to the image signal processing unit 902 is transferred to the engine control unit (DC controller) 2002 when a signal /PVDO is synchronized with a signal /PVCLK by synchronizing the vertical and horizontal directions with the signal /PTOP and a signal /PLSYNC, respectively. In this case, since the color mode is set, the engine control unit (DC controller) 2002 is operated four times to form images of four colors, i.e., C, M, Y, and K, in accordance with the image leading edge request signal /PTOP that is generated four times.

After the last image leading edge request signal /PTOP is generated, the print request signal /PPRNT is restored to high level (false). With this operation, the engine control unit (DC controller) 2002 detects the completion of the print request, and makes a shift to post-processing such as cleaning operation for the intermediate transfer medium.

The image-transferred print sheet passes through the fixing roller and is discharged through the designated paper discharge port. Finally, the reader controller 106 makes the engine control unit (DC controller) 2002 confirm that no print sheet is being conveyed (paper discharge operation is complete), terminates the print operation, and waits in a ready state until the next print request is generated.

Print Operation

Control operation to be performed when image data from the printer controller 2103 is output from the image forming apparatus in this embodiment will be described below.

When the above copy operation ends, the reader controller 106 is set in the ready state. In this case, the reader controller 106 disables the gate 2207 and the control circuit 2208 to perform print operation. The reader controller 106 makes the engine control unit (DC controller) 2002 check the ready state signal /PRDY of the printer by using the input/output port 2203. If this signal indicates "OK", the reader controller 106 sets a ready state signal /CRDY for the printer controller 2103 by using the input/output port 2206.

The printer controller 2103 performs communication to make various settings. The reader controller 106 receives the corresponding data through the serial communication controller 2205. The CPU 2209 then interprets the data.

In accordance with the contents of this data, the reader controller 106 makes various settings by using the serial communication controller 2202. In response to a series of commands, the engine control unit (DC controller) 2002 returns the corresponding status data to the reader controller 106, and the reader controller 106 receives the data by using the serial communication controller 2202. The CPU 2209 then interprets the contents of the received data and transmits the data to the printer controller 2103 by using the serial communication controller 2205.

The printer controller 2103 generates a print request /CPRNT to the reader controller 106. Upon reception of the print request /CPRNT, the reader controller 106 generates the print request signal /PPRNT to the engine control unit (DC controller) 2002.

In response to this signal, the engine control unit (DC controller) 2002 returns the signal /PTOP after a lapse of a predetermined period of time. This signal is returned as a signal /CTOP to the reader controller 106 through the control circuit 2208. A signal /CVDO is transferred to the reader controller 106 in synchronism with a signal /CVCLK by synchronizing the vertical and horizontal scanning directions, respectively, with the signal /CTOP and a signal /CLSYNC obtained when the signal /PLSYNC passes through the gate 2207.

In the reader controller 106, the selector 2201 is set to select a signal sent from the printer controller 2103, so that the signals sent from the printer controller 2103 are sent as signals /PVCLK, /PVDOEN, and /PVDO to the engine control unit (DC controller) 2002.

Difference between Print operation and Copy Operation

The difference associated with image output timing between the above print operation and the copy operation will be described below.

Although a detailed description of the arrangement of the printer controller 2103 will be omitted, the printer controller 2103 incorporates an image memory, in which image to be printed is prepared in advance. Therefore, the time required to output the image data /VDO in accordance with the image leading edge request signal /TOP sent from the engine control unit (DC controller) 2002 amounts to only an electrical delay time.

Figure 12:
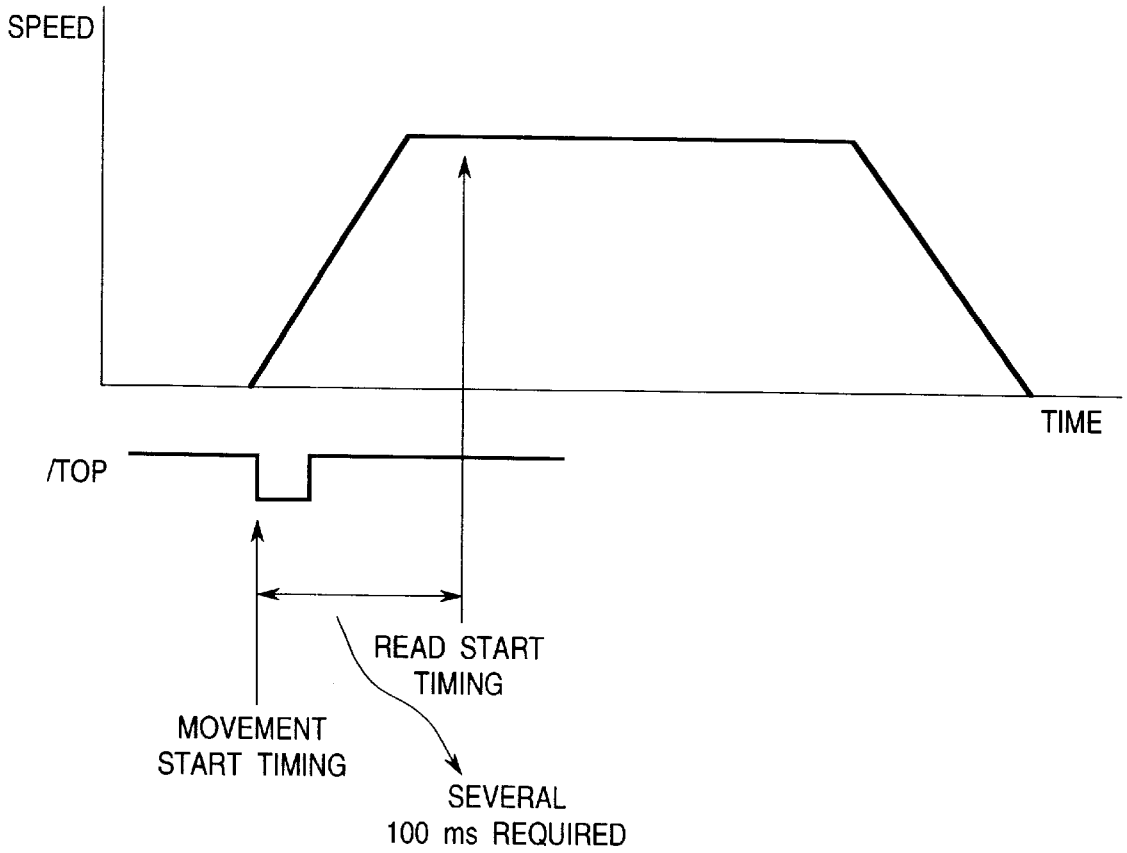
FIG. 12 is a graph for explaining the timing difference between copy operation and print operation in this embodiment.

In contrast to this, in the copy mode, an original is read while the optical reader 802 is moved, and image data is output. As shown in FIG. 12, to make the reader at rest move at a high speed to read an original, the time for acceleration is required. For example, a time of about several 100 ms is required.

If, therefore, the engine control unit (DC controller) 2002 outputs the image leading edge request signal /TOP in the copy mode at the same timing as that in the print mode, the image data /VDO reaches the printer engine unit with a delay of several 100 ms in the copy mode. To solve this problem, the signal /TOP may be output earlier in the copy mode than in the print mode.

When this method is to be used, the reader controller 106 may have the arrangement shown in FIG. 11. In the copy mode, the reader controller 106 may perform control the original reader to start moving in response to the signal /TOP.

As the second method of sending the print image data /VDO to the printer engine unit at the same timing in the copy and print modes, a method of preparing another signal (RSTRAT) in the copy mode is available.

Figure 13:
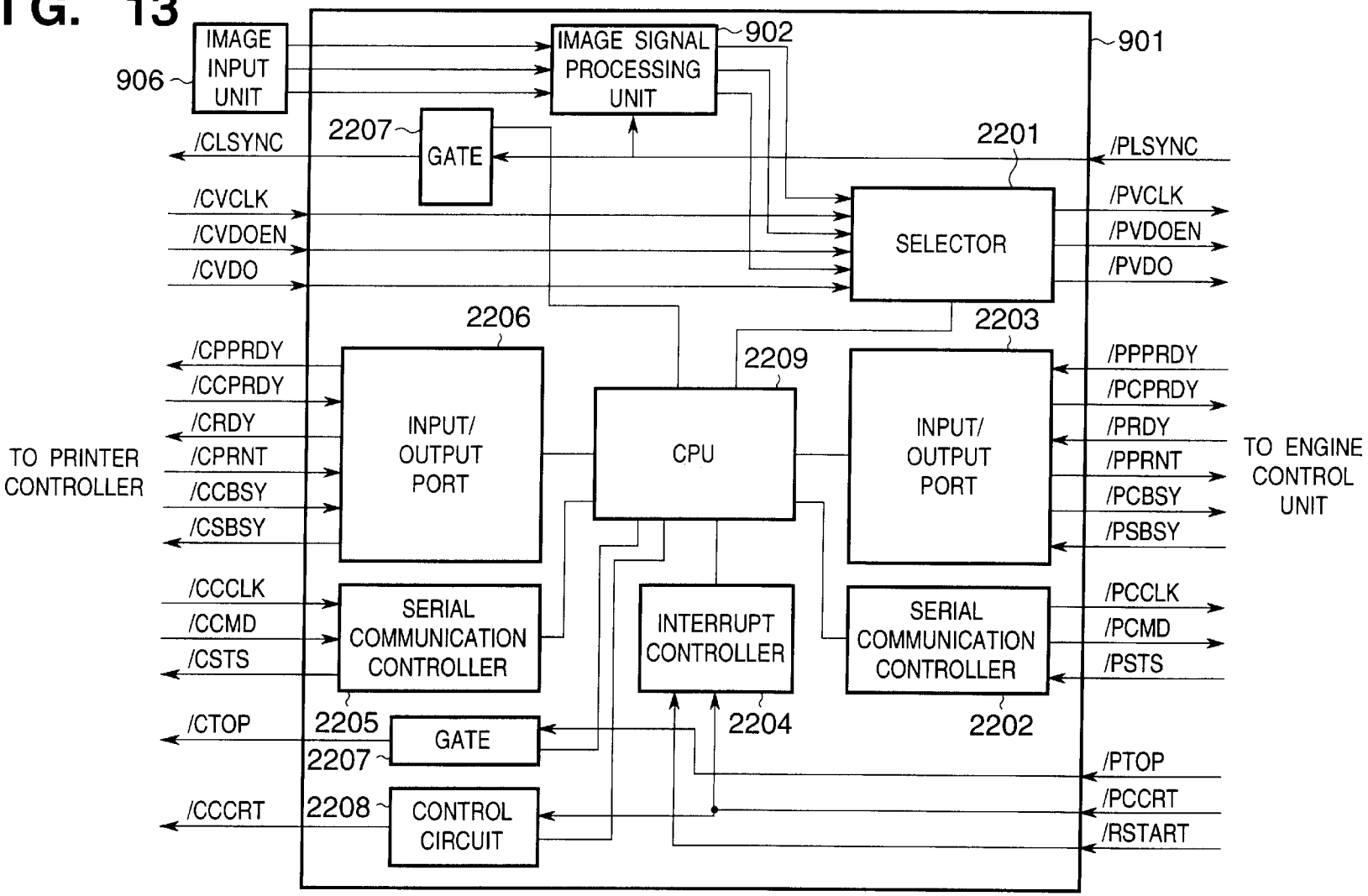
FIG. 13 is a block diagram showing the detailed arrangement of another reader controller in this embodiment.

To use the second method, the reader controller 106 must have the arrangement shown in FIG. 13. More specifically, the image leading edge request signal /PTOP output from the engine control unit (DC controller) 2002 is required only when the printer controller 2103 performs print operation, but need not be input to the interrupt controller of the reader controller 106. In addition, a read apparatus movement start request signal /RSTART output from the engine control unit (DC controller) 2002 is required only in the copy mode, but need not be sent to the printer controller 2103.

Control on Setting Command

Characteristic control in this embodiment will be described next. When the reader controller 106 is connected between the printer controller 2103 and the engine control unit (DC controller) 2002, communication between the printer controller 2103 and the engine control unit (DC controller) 2002 is performed as follows.

Consider a case in which a setting command, e.g., a paper feed cassette change command, is issued from the printer controller 2103 to the printer while the reader controller 106 reads an original image and outputs it by using the engine control unit (DC controller) 2002 (copy mode).

Figure 14:
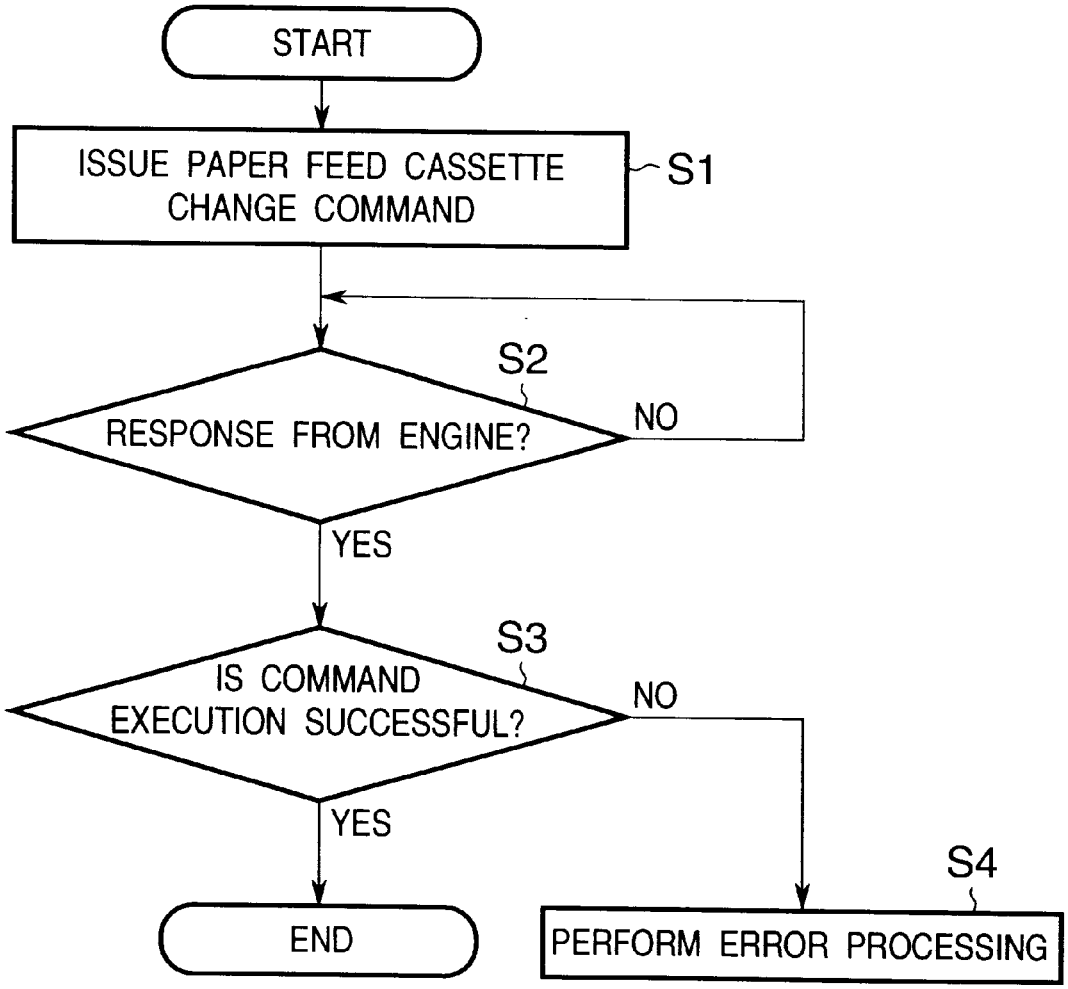
FIG. 14 is a flow chart showing a command issuing sequence to be executed in the printer controller without the reader controller in this embodiment.
Figure 15:
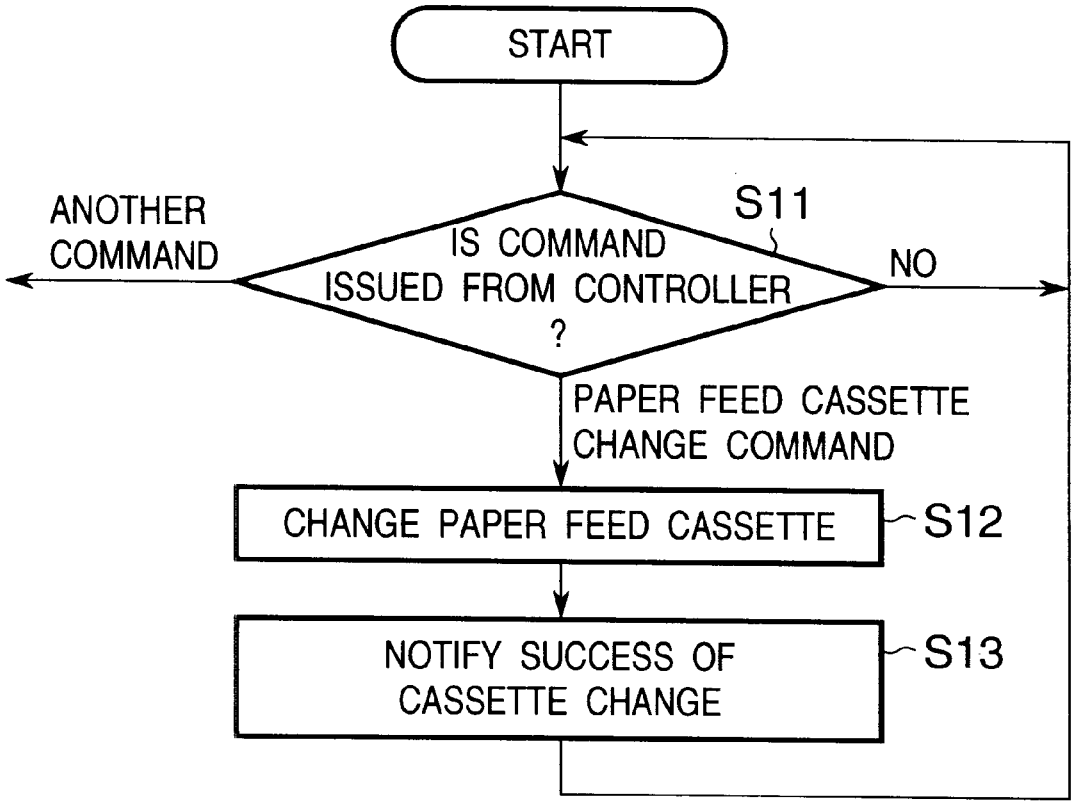
FIG. 15 is a flow chart showing a command issuing sequence to be executed in the DC controller without the reader controller in this embodiment.

FIGS. 14 and 15 are flow charts showing a command issuing sequence without the reader controller 106, i.e., in the arrangement shown in FIGS. 1 and 2. FIG. 14 is a flow chart showing processing in the printer controller 2103. FIG. 15 is a flow chart showing processing in the engine control unit (DC controller) 2002.

In step S1, the printer controller 2103 issues a paper feed cassette change command. In step S2, the printer controller 2103 waits for a response from the engine control unit (DC controller) 2002. When the printer controller 2103 receives the response, the flow advances from step S2 to step S3 to check whether command execution is successful. If YES in step S3, the processing is normally terminated.

If NO in step S3, the flow advances to step S4 to execute corresponding error processing.

In this manner, the command issuing sequence is terminated. Upon reception of the command from the printer controller 2103, the engine control unit (DC controller) 2002 determines the contents of the command. If the command is a paper feed cassette change command, the engine control unit (DC controller) 2002 notifies the printer controller 2103 of the success of command execution, when the cassette is successfully changed to another one.

Figure 16:
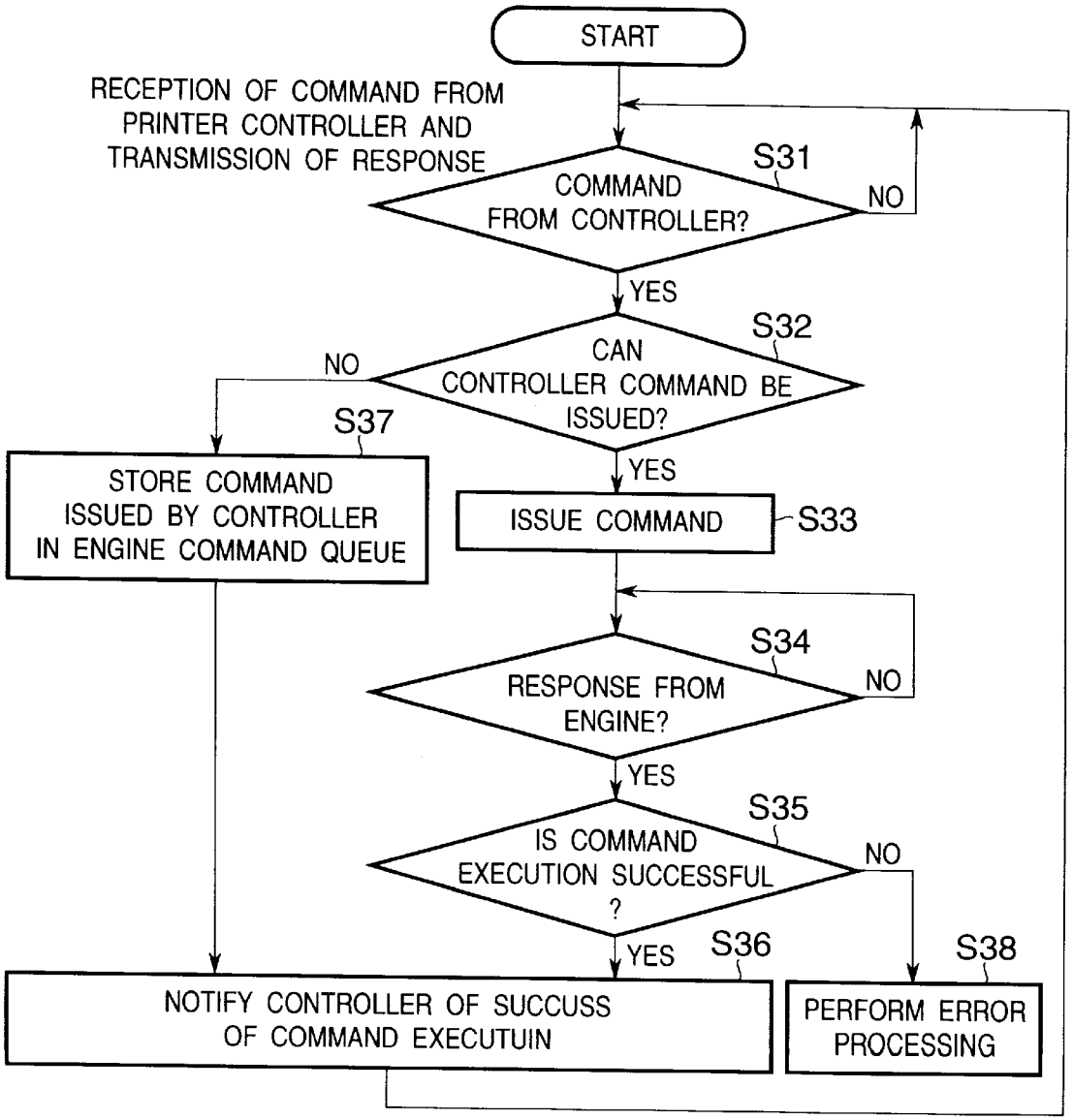
FIG. 16 is a flow chart showing control to be performed in the reader controller when a command received from the printer controller can be issued to the DC controller in this embodiment.
Figure 17:
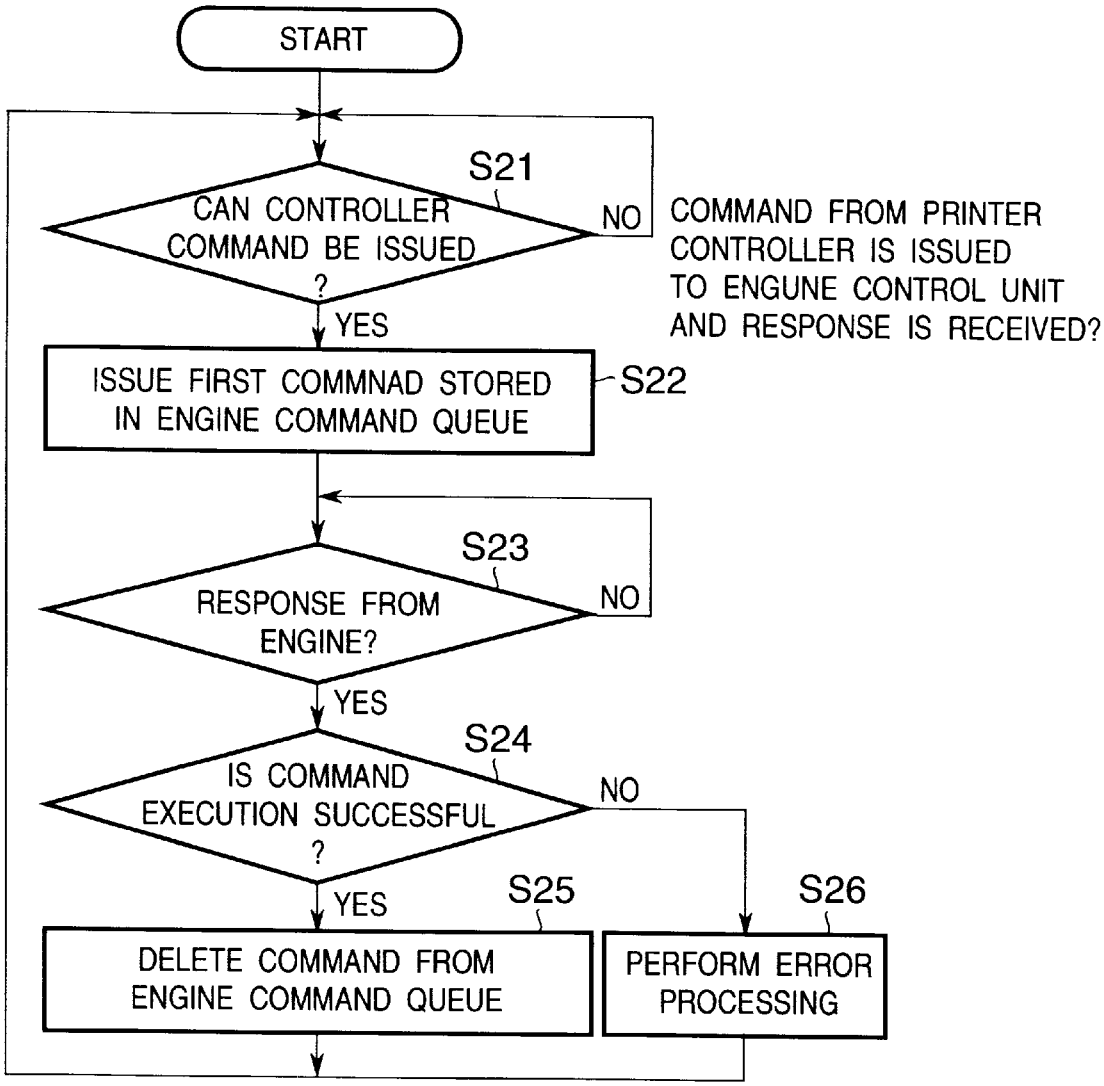
FIG. 17 is a flow chart showing control to be performed in the reader controller to receive a command from the printer controller and return status data to the printer controller in this embodiment.

FIGS. 16 and 17 are flow charts showing control in the reader controller 106 with the reader controller 106, i.e., in the arrangement shown in FIG. 10. Note that the printer controller 2103 and the engine control unit (DC controller) 2002 perform the same control as that descried with reference to FIGS. 14 and 15.

FIG. 16 is a flow chart for explaining control to be performed to receive a command from the printer controller 2103 and return status data to the printer controller 2103. FIG. 17 is a flow chart showing control to be performed when the command received from the printer controller 2103 can be issued to the engine control unit (DC controller) 2002 without any influence on the state of the reader controller 106.

Referring to FIG. 16, in step S31, the reader controller 106 checks whether the serial communication controller 2205 has received a command from the printer controller 2103 through a signal line /CCMD in FIGS. 10 and 11. If a command from the printer controller 2103 is received, the flow advances from step S31 to step S32 to check whether the current state allows the command to be directly issued to the engine control unit (DC controller) 2002.

Assume that when the paper feed cassette change command sent from the printer controller 2103 is directly issued to the engine control unit (DC controller) 2002, copy operation cannot be normally executed, as in a case in which the reader controller 106 is performing copy operation upon designating a paper feed cassette. In this case, the flow advances from step S32 to step S37 to store the command to be issued from the printer controller 2103 to the engine control unit (DC controller) 2002 in an engine command queue without issuing the command to the engine control unit (DC controller) 2002.

In step S36, since a response to the command must be returned to the printer controller 2103, the serial communication controller 2205 is used to return the response to the printer controller 2103 through a signal line /CSTS, assuming that the command from the reader controller 106 has been successfully executed. The flow then returns to step S31 to prepare for the next command.

If it is determined in step S32 that the received command can be directly issued to the engine control unit (DC controller) 2002, as in a case in which there is no command that is being executed by the reader controller 106 with respect to the engine control unit (DC controller) 2002 to perform copy mode operation, the flow advances to step S33.

In step S33, the reader controller 106 issues, to the engine control unit (DC controller) 2002, the same command as that sent in advance from the printer controller 2103, by using the serial communication controller 2202 through a signal line /PCMD.

When command execution is complete, a response is returned from the engine control unit (DC controller) 2002 to the reader controller 106 through a signal line /PSTS. The reader controller 106 therefore checks in step S34 whether a response is returned from the engine control unit (DC controller) 2002.

When a response is returned from the engine control unit (DC controller) 2002, the flow advances to step S35 to check whether the response indicates the success of command execution. If YES in step S35, the flow advances to step S36, in which the reader controller 106 determines that command execution is successful, and returns a response to the printer controller 2103 by using the serial communication controller 2205 through the signal line /CSTS. The flow then returns to step S31 to prepare for the next command.

If it is determined in step S35 that the response indicates that command execution is unsuccessful, the flow advances to step S38 to execute corresponding error processing. For example, corresponding error processing such as notifying the printer controller of the error state is performed.

A case in which the reader controller 106 is brought to a state in which it can issue, to the engine control unit (DC controller) 2002, a command received from the printer controller 2103 without influencing the state of the reader controller 106 will be described next with reference to FIG. 17.

In step S21, the reader controller 106 checks a state in which it can issue, to the engine control unit (DC controller) 2002, a command received from the printer controller 2103 without influencing the state of the reader controller 106. When the reader controller 106 is brought to a state in which it can issue, to the engine control unit (DC controller) 2002, a command received from the printer controller 2103, the flow advances to step S22 to issue the first command stored in an engine command queue to the engine control unit (DC controller) 2002 by using the serial communication controller 2202 through the signal line /PCMD.

In step S23, the reader controller 106 checks whether a response is returned from the engine control unit (DC controller) 2002. If a response is returned from the engine control unit (DC controller) 2002, the flow advances to step S34 to check whether the response indicates the success of command execution.

If command execution is successful, the flow advances to step S25 to delete this command from the engine command queue. The flow then returns to step S21 to issue the next command stored in the engine command queue.

It is determined in step S24 that the response indicates that command execution is unsuccessful, the flow advances to step S26 to execute corresponding error processing. For example, corresponding error processing such as notifying the printer controller 2103 of the error state is performed.

As described above, in the arrangement with the reader controller 106 as well, when a command is normally issued from the printer controller 2103 to the engine control unit (DC controller) 2002, a command processing sequence can be effected without causing any mismatch in operation.

Control on State Change Signal

Assume that in the arrangement with the reader controller 106, information indicating a change in the state on the engine state, e.g., the occurrence of some kind of error, is transmitted from the engine control unit (DC controller) 2002 side to the reader controller 106 by using the signal /PCCRT. Processing to be performed in this state will be described next.

In the arrangement with the reader, changes in state which should be known on the reader controller 106 and the printer controller 2103 may differ from each other, as in a case in which a change in state, e.g., a paper jam during conveyance of the paper, occurs.

If a paper jam occurs while the printer engine unit is performing copy operation under the control of the reader controller 106, only the reader controller 106 should know this state. Even if the printer controller 2103 is notified of this state, no proper processing can be performed because this paper jam has not occurred while the printer controller 2103 is outputting data.

If a control system equivalent to the reader controller 106 is to be added to this apparatus, the two controllers will incorporate software for jam processing control, which the other controller should have, resulting in redundancy. As a consequence, a lot of waste is produced in terms of the number of steps, quality evaluation, and the capacity for software.

Basically, therefore, in the print mode, the printer controller 2103 may be notified of the above information, whereas in the copy mode, the reader controller 106 may be notified of the information.

In the copy mode as well, however, the printer controller 2103 may need an engine state change signal. For example, information such as a change in cassette size or a paper-out condition must be notified to the printer controller 2103 as well. As for such information, however, a very strict condition is not set for the time interval between the instant at which a state change signal is issued from the engine control unit (DC controller) 2002 and the instant at which corresponding processing is performed in each controller.

Figure 18:
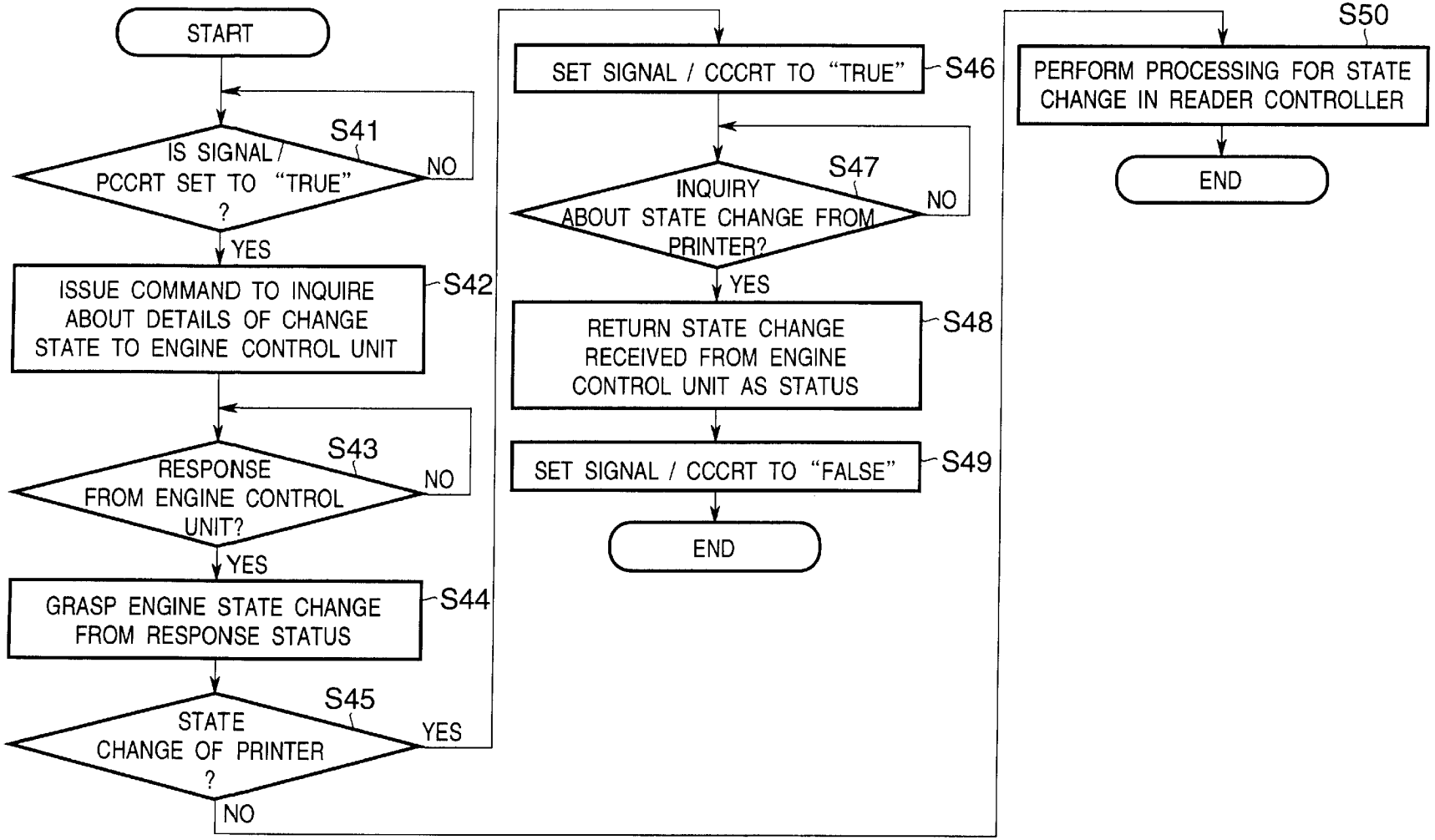
FIG. 18 is a flow chart showing processing for a printer state change signal /CCRT when the reader controller is attached to the apparatus of this embodiment.

The reader controller 106 in this embodiment performs the processing shown in FIG. 18 as control on a state change signal.

More specifically, in the copy mode in which the reader controller 106 controls the engine control unit (DC controller) 2002, the gate function of the control circuit 2208 is used to mask the state change signal /PCCRT, notified by the engine control unit (DC controller) 2002, with respect to the printer controller 2103, and only the reader controller 106 receives this signal through the interrupt controller 2204.

First of all, in step S41 in FIG. 18, the reader controller 106 checks whether the printer state change signal /PCCRT is true. When the printer state change signal /PCCRT becomes true, the flow advances to step S42, in which the reader controller 106 issues a command to acquire state change information to the engine control unit (DC controller) 2002.

In step S43, the reader controller 106 waits for a response from the engine control unit (DC controller) 2002 to this command. When the response is returned from the engine control unit (DC controller) 2002, the flow advances to step S44 to check the response status and grasp the contents of the change in the state of the engine.

In step S45, it is checked whether the contents of the response status indicate a state change associated with the printer and are to be notified to the printer controller 2103 as well. For example, it is determined that a state change such as a change in paper feed cassette size is to be notified. If it is determined that the contents are to be notified to the printer controller 2103 as well, the flow advances to step S46 to make the control circuit 2208 set a flag to generate a state change signal /CCCRT, thereby notifying the printer controller 2103 of the contents.

In step S47, the reader controller 106 waits for an inquiry about a state change from the printer controller 2103. If an inquiry is made, the flow advances to step S48 to return the state change information, received from the engine control unit (DC controller) 2002, as status data. In step S49, in the print mode in which the engine control unit (DC controller) 2002 is controlled, the gate function of the control circuit 2208 is released, and the printer state change signal /PCCRT notified from the engine control unit (DC controller) 2002 is notified as the state change signal /CCCRT to the printer controller 2103. Thereafter, the processing is terminated.

If it is determined in step S45 that the state change is not associated with the printer and the contents are not to be notified to the printer controller 2103, the flow advances to step S50 to perform processing for the state change in the reader controller 106. Thereafter, this processing is terminated.

Control on Execution Command

Control on an execution command in this embodiment will be described next. Assume that the printer controller 2103 and the reader controller 106 simultaneously output requests to use the engine control unit (DC controller) 2002. How the reader controller 106 controls this will be described.

Figure 19:
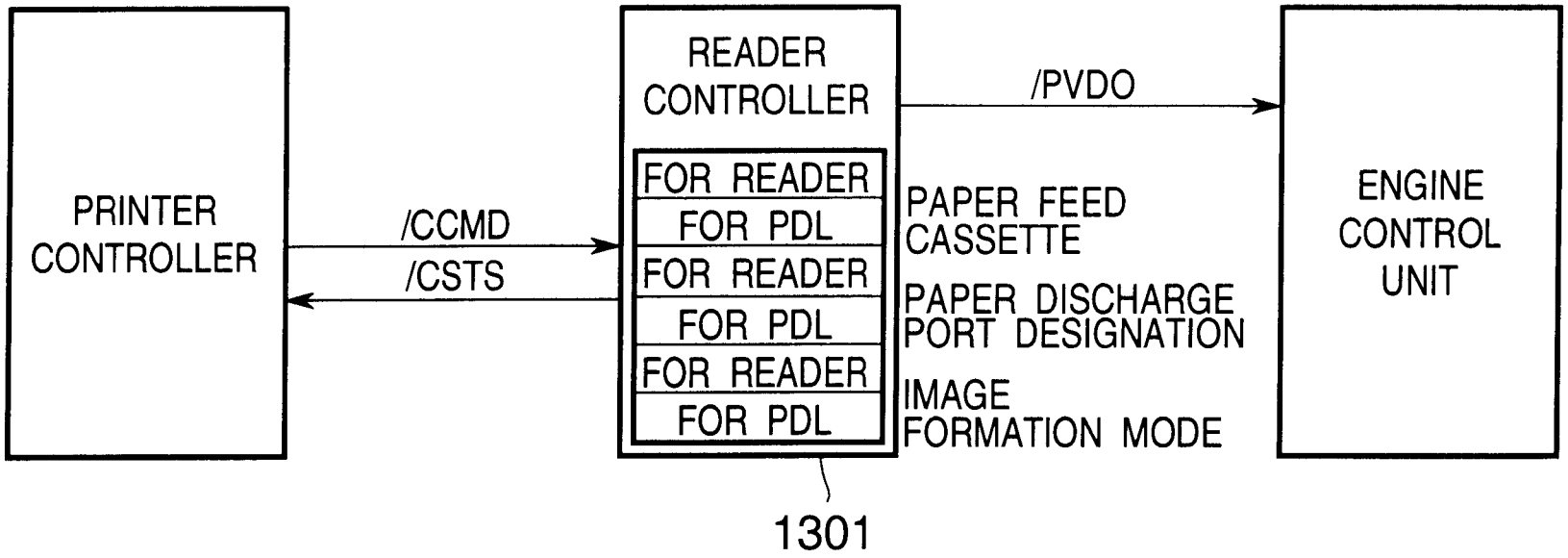
FIG. 19 is a block diagram showing the locations of data and the exchange of the data when a print request is generated during copy operation in this embodiment.

FIG. 19 is a view showing the locations of data and the exchange of the data when a print request is generated during copy operation. When a print request is generated during copy operation, the engine control unit (DC controller) 2002 receives the image signal /PVDO from the reader controller 106 and forms an image.

In this operation, as shown in FIG. 7, settings such as the designation of a paper feet cassette, the designation of a paper discharge port, and an image formation mode have already been made in serial communication between the reader controller 106 and the engine control unit (DC controller) 2002.

Referring to FIG. 19, reference numeral 1301 denotes a buffer for various set values. The values set in the engine control unit (DC controller) 2002 by the reader controller 106 and the values set in the engine control unit (DC controller) 2002 by the printer controller 2103 are stored in the buffer 1301. Of the set values shown in the buffer 1301, the above values are stored as set values for the reader.

It is inconceivable in terms of usability that print operation interrupts copy operation when a print request is generated by the printer controller 2103 during copy operation. In this embodiment, therefore, the print request in this state is delayed until the copy operation is complete. However, /CSTS must be returned in response to /CCMD from the printer controller 2103. Of the set values in the buffer 1301, therefore, only a set value from the printer is set as a set value for PDL in response to the request.

If a set value for the reader differs from a set value for PDL, the reader controller 106 may make the corresponding setting in the engine control unit (DC controller) 2002 before print operation is started upon completion of copy operation.

Assume that copy operation is currently performed, a print sheet is fed from the upper cassette, a setting is made to discharge the print sheet through the face-up discharge port, and the image formation mode is set to the color mode in accordance with determination that an original is a color original.

In this case, when a print request is generated by the printer controller 2103, various settings can be made although the execution of print operation is delayed. Assume that the print request is a request to feed a print sheet from the upper cassette, discharge it through the facedown discharge port, and output a monochrome image.

Both the reader controller 106 and the printer controller 2103 have designated the upper cassette as a cassette from which a print sheet is to be fed. When, therefore, the copy operation is switched to the print operation upon completion of the copy operation, no paper feed cassette designation command needs to be issued to the engine control unit (DC controller) 2002.

Since different paper discharge ports and image formation modes are designated in copy operation and print operation, the reader controller 106 must issue commands to designate a paper discharge port and an image formation mode to the engine control unit (DC controller) 2002 when the copy operation is complete.

As described above, the reader controller 106 does not perform determination processing to only delay the execution of a command from the printer controller 2103 to the engine control unit (DC controller) 2002, but performs determination processing so as not to redundantly set information that has been set by the reader controller 106 for the engine control unit (DC controller) 2002.

Figure 20:
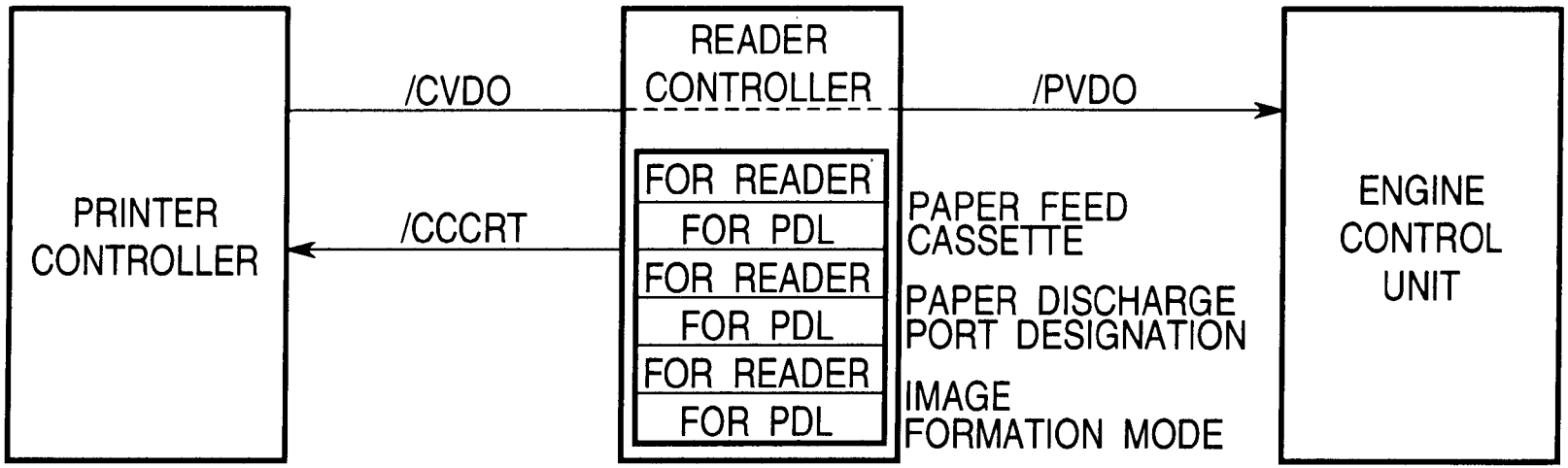
FIG. 20 is a block diagram showing processing to be performed when a copy request is generated during print operation in this embodiment.

A case in which a copy request is generated during print operation in this embodiment will be described next with reference to FIG. 20. FIG. 20 shows processing to be performed when a copy request is generated during print operation in this embodiment.

In contrast to the case shown in FIG. 19, in this case, in terms of usability, that copy operation can be executed during print operation is better than that copy operation cannot be performed during print operation even when the user depresses the coy button on the copying machine.

In this case, the signal /CVDO sent from the printer controller 2103 is selected by the selector 2201 and sent as the signal /PVDO to the engine control unit (DC controller) 2002. Assume that the upper cassette, the facedown paper discharge port, and the monochrome mode are set from the printer controller 2103 as in the case shown in FIG. 19.

The engine control unit (DC controller) 2002 does not know how many printouts are produced, because the engine control unit (DC controller) 2002 can detect the end of operation only when the print request signal /PPRNT from the printer controller 2103 is set at high level (false). Assume that the printer is to print out images corresponding to four print sheets.

If the reader does not generate a copy request by an interrupt, four image leading end request signals /PTOP are generated by the engine control unit (DC controller) 2002 as indicated by the image timing shown in FIG. 5. In according to these signals, the printer controller 2103 sends images to the engine control unit (DC controller) 2002 through the reader controller 106.

Figure 21:
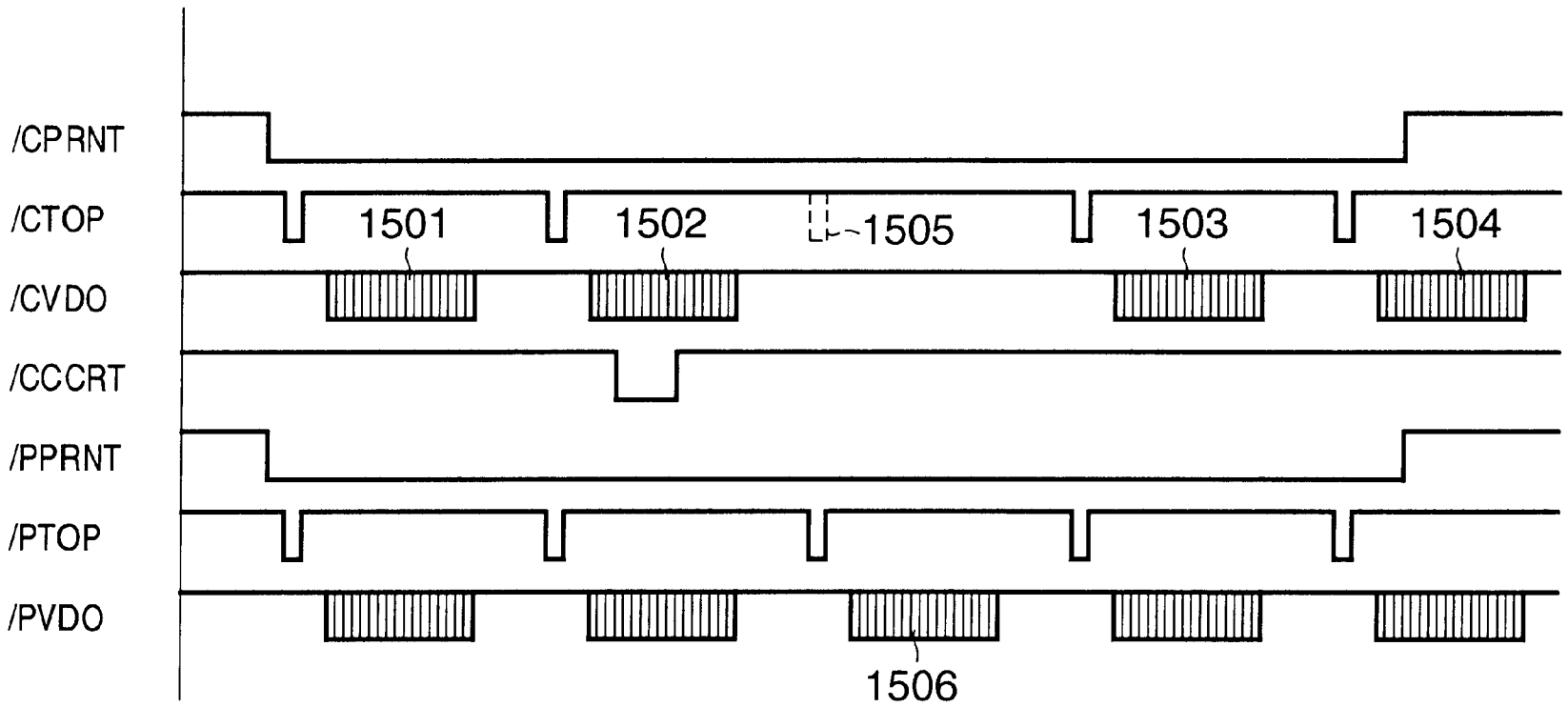
FIG. 21 is a timing chart showing control to be performed when an interrupt copy request is generated in the reader controller in this embodiment.

Assume that the reader controller 106 generates an interrupt copy request to produce one copy of a color original while the second printout is being produced. This operation will be described with reference to FIG. 21. FIG. 21 is a timing chart showing control to be performed when an interrupt copy request is generated by the reader controller 106 in this embodiment.

In response to the request /CPRNT from the printer controller 2103, the reader controller 106 issues the print request signal /PPRNT to the engine control unit (DC controller) 2002, and the signal /PTOP is supplied as the signal /CTOP from the engine control unit (DC controller) 2002 to the printer controller 2103 through the reader controller 106. In this manner, print operation for a first image 1501 and a second image 1502 are performed.

A case in which the reader controller 106 generates an interrupt copy request during print operation for the second printout will be described. The reader controller 106 generates the signal /CCCRT to the printer controller 2103. In this case, the state of the engine has not changed actually, but the reader generates an engine release request to the printer controller 2103 to assume control of the printer engine. As described above, the signal /CCCRT is generated by using the control circuit 2208.

In response to this signal /CCCRT, the printer controller 2103 issues a command to check the status of the engine. In response to this command, the reader controller 106 returns status data indicating "copy operation" to the printer controller 2103.

With this operation, the printer controller 2103 detects that the engine is in the process of copy operation and waits for the signal /CTOP, while the signal /CPRNT is kept at low level (true). If the engine is not in the process of copy operation, a timeout error occurs after a lapse of a predetermined period of time, when the signal /CTOP does not arrive while the signal /CPRNT is kept at low level (true). If the engine is in the process of copy operation, the timeout is canceled on the printer controller 2103 side to permanently wait for the signal /CTOP.

In this embodiment, the signal /PTOP sent from the engine control unit (DC controller) 2002 is used for copy operation and used on the reader controller 106.

As indicated by reference numeral 1505, the signal /PTOP sent from the engine side is masked with respect to the printer controller 2103. In practice, only an image signal for an image 1506 is generated by the reader controller 106.

After one printout is produced by interrupt copy operation, the mask of the signal /PTOP is removed, and the signal /PTOP is sent as the signal /CTOP to the printer controller 2103, thereby printing out the images 1503 and 1504 from the printer controller 2103 to the engine control unit (DC controller) 2002.

With the control described above, interrupt copy operation during print operation can be realized.

In this manner, the reader controller 106 determines alone, in accordance with the state of the printer controller 2103 or the reader controller 106, whether a command is issued at the timing at which the printer controller 2103 or the reader controller 106 assumes control of the printer engine, and performs corresponding control, thereby realizing requests from the two controllers to the one engine.

Control on Set Content Check Command

Control to be performed when the printer controller 2103 issues a set content check command in this embodiment will be described next.

When the printer controller 2103 wants to check the state set in the engine control unit (DC controller) 2002, the printer controller 2103 issues a set content check command through the signal line /CCMD. Upon reception of this signal, the reader controller 106 checks the set value storage buffer in FIG. 19. If the contents to be checked by the printer controller 2103 are stored in the set value storage buffer, the reader controller 106 reads out the contents and notifies the printer controller 2103 of the contents through the signal line /CSTS.

If the contents are not stored in the set value storage buffer in FIG. 19, the reader controller 106 issues a set content check command through the signal line /PCMD. The engine control unit (DC controller) 2002 reads out the contents and notifies the reader controller 106 of the set contents through the signal line /PSTS. The reader controller 106 then notifies the printer controller 2103 of the contents through the signal line /CSTS.

One-Side Fixing Heater Non-Energization Control by Reader Controller 106 in Two-Page Formation Mode When the reader unit and the printer unit are connected to each other, the arrangement in FIG. 9 is obtained, and the image data signal read by the original reader flows in the above manner. The operation of the printer which is to be performed when two-page toner images are transferred onto the intermediate transfer medium 405 in FIG. 9 in the two page formation mode will be described.

The "two-page formation mode" will be described below. When the two-page formation mode is designated, the reader unit reads the first original image and outputs image data corresponding to the first original image to the printer unit. The printer unit forms an electrostatic latent image on the photosensitive member 402 by using the scanner 402 on the basis of the image data which is input from the reader unit and corresponds to the first original image. The printer unit then transfers this image onto the intermediate transfer medium 405.

Subsequently, the reader unit reads the second original image and outputs image data corresponding to the second original image to the printer unit. The printer unit forms an electrostatic latent image on the photosensitive member 402 by using the scanner 402 on the basis of the image data which is input from the reader unit and corresponds to the second original image. The printer unit then transfers this image onto the intermediate transfer medium 405. In this manner, the two-page images are formed on the intermediate transfer medium 405.

Two print sheets are sequentially fed, and the two-page toner images on the intermediate transfer medium 405 are sequentially transferred onto the print sheets.

This operation will be described in detail below.

As described above, the reader controller 106 makes various settings associated with a paper feed port, a paper discharge port, and a color mode, and sets the two-page formation mode. Thereafter, the reader controller 106 sets the signal /PPRNT at low level (true).

Upon confirming that the signal /PPRNT is at low level (true), the printer apparatus transmits the signal /PTOP to the reader controller 106 at a predetermined timing. As described above, the reader controller 106 sets an original from the document feeder 801 on the original table with reference to the signal /RTOP at a predetermined timing, and scans the original. In this case, since copy operation is performed in the two-page formation made, the signal IRTOP is output from the engine control unit (DC controller) 2002 to the reader controller 106 twice at predetermined timings. In this case, the predetermined timings are timings at which two-page images are formed on the intermediate transfer medium.

The image data on the original which is scanned is converted into an image signal in units of pixels by the image processing unit, the resultant image data is output as a video signal to the engine control unit (DC controller) 2002 at a predetermined timing.

In the two-page formation mode on the printer apparatus side, as the interval between images decreases, the time required to move the optical read head 806 to the home position for the second image shortens. The load exerted on the scanner motor for returning the optical read head 806 to the home position (to be referred to as "back scanning" hereinafter) increases, and the power consumption increases accordingly.

When the automatic document feeder is used, replacement of the original with the next original must be performed in this interval as well as back scanning, the power consumption in the interval becomes considerably large.

In this embodiment, at the end of first original scanning operation, the reader controller 106 sets the fixing heater control signal /STOPHEAT in FIG. 10 at low level (true) to forcibly set the fixing heater 407 on one side in a non-energization state.

As shown in FIG. 10, the signal /STOPHEAT is a control signal used when the reader controller 106 controls the engine control unit (DC controller) 2002 to inhibit driving of one of the fixing heaters (not shown). When this signal is set at low level (true), the engine control unit (DC controller) 2002 performs control to set one of the fixing heaters in the non-energization state.

Upon reception of the signal /STOPHEAT, the engine control unit (DC controller) 2002 performs control so as not to simultaneously turn on the fixing heaters (not shown) in the fixing roller 407 and the press roller.

When back scanning of the optical read head 806 ends, the reader controller 106 sets the signal /STOPHEAT at high level (false) to restore the engine control unit (DC controller) 2002 to normal fixing heater control.

The engine control unit (DC controller) 2002 inhibits a one-side energization state, except in the two-page formation mode, even when it receives the signal /STOPHEAT. If the one-side energization state is set too often, a deterioration in fixing performance occurs, because such fixing control is optional.

Figure 22:
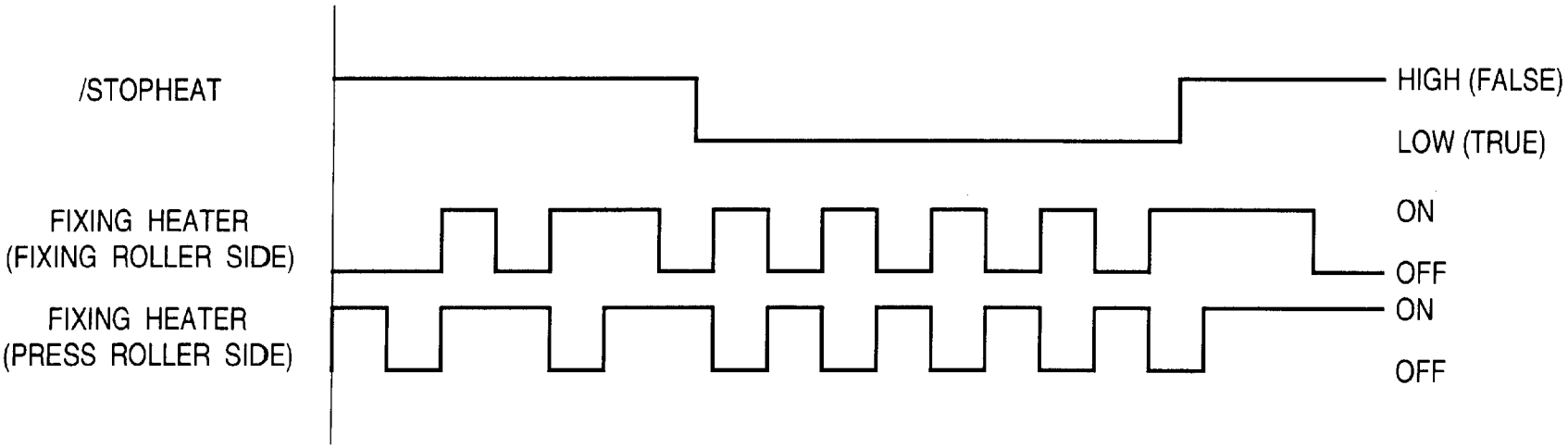
FIG. 22 is a timing chart for explaining fixing heater control upon reception of a signal /STOPHEAT in this embodiment.

FIG. 22 shows an example of how the respective fixing heaters are controlled upon reception of the signal /STOPHEAT. As shown in FIG. 22, while the signal /STOPHEAT is at low level (true), the two fixing heaters are not simultaneously turned on, but one of the heaters is always set in the non-energization state.

As described above, according to this embodiment, when image data read by the original reader are to be printed out in the two-page formation mode, control is performed to forcibly set one of the fixing heaters in the fixing roller and the press roller in the non-energization state. By forcibly turning off one of the fixing heaters, an increase in total power consumption can be prevented even if the interval between images is small.

OTHER EMBODIMENTS

In the above embodiment, two-page toner images are transferred onto the intermediate transfer medium 405, these toner images are sequentially transferred onto print sheets. However, two print sheets may be directly placed on the intermediate transfer medium 405, and the toner images on the photosensitive member may be directly transferred onto the print sheets on the intermediate transfer medium 405.

In addition, the above "two-page formation mode" is only an example used when the image formation intervals between a plurality of images to be continuously formed is small. However, the present invention is not limited to this. Obviously, the present invention can be applied to all cases in which the interval between the instant at which the first image is formed and the instant at which the second image is formed is relatively short. During this interval, for example, the scan head must be moved backward at a high speed, or the automatic document feeder must be driven at a high speed. It is therefore expected that a high power peak appears. By applying the present invention, an increase in power peak can be suppressed.

In addition, the printer is not limited to a printer capable of forming color images, and may be designed to form only black (monochrome) images.

Furthermore, the present invention can be applied to a case in which toner images formed on the photosensitive member are sequentially transferred onto print sheets without using any intermediate transfer medium.

Note that the present invention may be applied to either a system constituted by a plurality of devices (e.g., a host computer, an interface device, a reader, a printer, and the like), or an apparatus consisting of a single device (e.g., a copying machine, a facsimile apparatus, or the like).

The objects of the present invention are also achieved by supplying a storage medium, which records a program code of a software program that can realize the functions of the above-mentioned embodiments to the system or apparatus, and reading out and executing the program code stored in the storage medium by a computer (or a CPU or MPU) of the system or apparatus.

In this case, the program code itself read out from the storage medium realizes the functions of the above-mentioned embodiments, and the storage medium which stores the program code constitutes the present invention.

As the storage medium for supplying the program code, for example, a floppy disk, hard disk, optical disk, magneto-optical disk, CD-ROM, CD-R, magnetic tape, nonvolatile memory card, ROM, and the like may be used.

The functions of the above-mentioned embodiments may be realized not only by executing the readout program code by the computer but also by some or all of actual processing operations executed by an OS (operating system) running on the computer on the basis of an instruction of the program code.

Furthermore, the functions of the above-mentioned embodiments may be realized by some or all of actual processing operations executed by a CPU or the like arranged in a function extension board or a function extension unit, which is inserted in or connected to the computer, after the program code read out from the storage medium is written in a memory of the extension board or unit.

When the present invention is applied to the above storage medium, program codes corresponding to the flow charts described above are stored in the storage medium.

As described above, power consumption can be suppressed by properly performing heating control on the heater in the fixing unit. Assume that a certain period of time is allowed between the instant at which one image is formed on the intermediate transfer medium and the instant at which the next image is formed. In this case, the heating time of the heater can be suppressed to a short period of time, and hence an increase in the power consumption of the overall apparatus can be suppressed.

As many apparently widely different embodiments of the present invention can be made without departing from the spirit and scope thereof, it is to be understood that the invention is not limited to the specific embodiments thereof except as defined in the appended claims.

What is claimed is:

1. An image forming method of forming a toner image on a photosensitive member, transferring the toner image formed on the photosensitive member onto a printing medium, and fixing the toner image transferred onto the printing medium by using a plurality of heaters, said method comprising the step of inhibiting driving of at least one of the plurality of heaters in an interval between forming a toner image and continuously forming a next toner image.

2. The method according to claim 1, further comprising the step of reading a plurality of original images and sequentially forming toner images on the photosensitive member.

3. The method according to claim 2, further comprising the step of inhibiting driving of at least one of the plurality of heaters in an interval between reading one original image and reading a next original image.

4. The method according to claim 3, further comprising the step of returning an image read head for scanning an original image backward in an interval between reading one original image and reading a next original image.

5. An image forming method of forming images corresponding to a plurality of pages on an image carrier capable of carrying toner images corresponding to a plurality of pages, and sequentially fixing toner images corresponding to the plurality of pages, formed on the image carrier, on printing media by using a plurality of heaters, said method comprising the step of inhibiting driving of at least one of the plurality of heaters in an interval between forming one of the toner images corresponding to the plurality of pages and forming a next image.

6. The method according to claim 5, further comprising the step of forming toner images corresponding to a plurality of pages on the image carrier by transferring toner images formed on a photosensitive member onto the image carrier.

7. The method according to claim 5, further comprising the step of reading a plurality of original images and sequentially forming toner images on the image carrier.

8. The method according to claim 7, further comprising the step of inhibiting driving of at least one of the plurality of heaters in an interval between when an image reader unit reads one original image and when the image reader unit reads a next original image.

9. The method according to claim 8, further comprising the step of moving an image read head for scanning original images backward in an interval between when one original image is read and when a next original image is read.

10. An image processing apparatus comprising:

a toner image forming unit for forming a toner image on a photosensitive member;

a transfer unit for transferring the toner image formed on the photosensitive member onto a printing medium;

a fixing unit for fixing the toner image transferred onto the printing medium by using a plurality of heaters; and an inhibitor for inhibiting driving of at least one of the plurality of heaters in an interval between the instant when a toner image is formed and when a next toner image is continuously formed.

11. The apparatus according to claim 10, further comprising an image reader unit for reading an original image.

12. The apparatus according to claim 11, wherein said inhibitor inhibits driving of at least one of the plurality of heaters in an interval between when the image reader unit reads one original image and when the image reader unit reads a next original image.

13. The apparatus according to claim 12, wherein the image reader unit moves an image read head for scanning an original image backward in an interval between reading one original image and reading a next original image.

14. An image processing apparatus comprising:

a toner image forming unit for forming toner images corresponding to a plurality of pages on an image carrier capable of carrying images corresponding to a plurality of pages;

a fixing unit for fixing toner images corresponding to the plurality of pages and formed on the image carrier by using a plurality of heaters; and an inhibitor for inhibiting driving of at least one of the plurality of heaters in an interval between forming one of the toner images corresponding to the plurality of pages and forming a next toner image.

15. The apparatus according to claim 14, further comprising a transfer unit for transferring a toner image formed on a photosensitive member onto the image carrier.

16. The apparatus according to claim 15, further comprising an image reader unit for reading a plurality of original images.

17. The apparatus according to claim 16, wherein said inhibitor inhibits driving of at least one of the plurality of heaters in an interval between when said image reader unit reads one original image and when a next original image is read.

18. The apparatus according to claim 17, wherein an image read head for scanning an original image is moved backward in an interval between when one original image is read and when a next original image is read.

19. A computer-readable storage medium storing a computer program for executing the image forming method defined in claim 1.

20. A computer program product for executing the image forming method defined in claim 1.

21. An image forming method of reading an original image, forming a toner image on a photosensitive member, and fixing the toner image transferred onto a printing medium by using a plurality of heaters, said method comprising the step of inhibiting driving of at least one of the plurality of heaters in an interval between reading an original image and continuously reading a next original image.

22. The method according to claim 21, further comprising the step of reading a plurality of original images and sequentially forming toner images on the photosensitive member.

23. The method according to claim 22, further comprising the step of returning an image read head for scanning an original image backward in an interval between reading one original image and reading a next original image.

24. An image processing apparatus comprising:

an image reader unit for reading an original image;

a toner image forming unit for forming a toner image on a photosensitive member;

a fixing unit for fixing the toner image transferred onto a printing medium by using a plurality of heaters; and an inhibitor for inhibiting driving of at least one of the plurality of heaters in an interval between when an original image is read and when a next original image is continuously read.

25. The apparatus according to claim 24, wherein said image reader unit moves an image read head for scanning an original image backward in an interval between reading one original image and reading a next original image.

26. A computer-readable storage medium storing a computer program for executing the image forming method defined in claim 21.

27. A computer program product for executing the image forming method defined in claim 21.

* * * * *

UNITED STATES PATENT AND TRADEMARK OFFICE

CERTIFICATE OF CORRECTION

PATENT NO. : 6,151,463
DATED : November 21, 2000
INVENTOR(S) : Shigemichi Hamano It is certified that error appears in the above-identified patent and that said Letters Patent is hereby corrected as shown below:

Sheet 4,
FIG. 17, "COMMNAD" should read -- COMMAND --; and "ENGUNE" should read -- ENGINE --.

Column 4,
Line 42, "printe" should read -- printer --.

Column 7,
Line 38, "anda" should read -- and a --.

Column 8,
Line 14, "thelowermost" should read -- the lowermost --.

Column 14,
Line 41, "descried" should read -- described --.

Column 17,
Line 52, "feet" should read -- feed --.

Column 18,
Line 53, "coy" should read -- copy --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*